US007614989B1

(12) United States Patent
Wu

(10) Patent No.: US 7,614,989 B1
(45) **Date of Patent: *Nov. 10, 2009**

(54) BEND AND STRETCH ABDOMINAL AND LOWER BACK EXERCISE MACHINE

(76) Inventor: Qingping Wu, 40 Irving Ave., Englewood Cliffs, NJ (US) 07632

( * ) Notice: Subject to any disclaimer, the term of this patent is extended or adjusted under 35 U.S.C. 154(b) by 0 days.

This patent is subject to a terminal disclaimer.

(21) Appl. No.: 12/143,488

(22) Filed: Jun. 20, 2008

Related U.S. Application Data

(62) Division of application No. 11/140,289, filed on May 27, 2005, now Pat. No. 7,390,289, which is a division of application No. 10/135,957, filed on Apr. 30, 2002, now Pat. No. 6,939,272.

(60) Provisional application No. 60/290,373, filed on May 11, 2001.

(51) Int. Cl.
*A63B 26/00* (2006.01)

(52) U.S. Cl. ..... 482/142; 482/140

(58) Field of Classification Search ..... 482/92, 482/97, 100, 127, 130, 137, 142, 145
See application file for complete search history.

(56) References Cited

U.S. PATENT DOCUMENTS

| | | | | |
|---|---|---|---|---|
| 1,990,124 | A | 2/1935 | Kabisius | |
| 2,472,391 | A | 6/1949 | Albizu | |
| 4,546,967 | A | 10/1985 | Kecala | |
| 4,729,562 | A | 3/1988 | Pipasik | |
| 4,753,126 | A | 6/1988 | Sammaratano | |
| 5,002,043 | A | 3/1991 | George | |
| 5,050,589 | A | 9/1991 | Engle | |
| 5,135,457 | A | 8/1992 | Caruso | |
| 5,146,316 | A | 9/1992 | Suzuki | |
| 5,282,748 | A | 2/1994 | Little | |
| 5,300,005 | A | 4/1994 | Wang | |
| 5,376,060 | A | 12/1994 | Murray | |
| 5,470,291 | A | 11/1995 | Pekkanen | |
| 5,575,743 | A | 11/1996 | Jones et al. | |
| 5,624,361 | A | 4/1997 | Lai | |
| 5,665,041 | A | 9/1997 | Hsieh | |
| 5,672,143 | A | 9/1997 | Ish, III | |
| 5,681,247 | A | 10/1997 | Webber | |
| 5,716,308 | A | 2/1998 | Lee | |
| 5,752,879 | A | 5/1998 | Berdut | |
| 5,779,601 | A | 7/1998 | Ish, III | |
| 5,795,271 | A | 8/1998 | Pearson | |
| 5,833,590 | A | 11/1998 | Chiu et al. | |
| 5,868,654 | A | 2/1999 | Norian | |
| 5,871,425 | A * | 2/1999 | Gvoich | 482/140 |
| 5,928,118 | A * | 7/1999 | Rosenthal | 482/99 |

(Continued)

*Primary Examiner*—Lori Amerson
(74) *Attorney, Agent, or Firm*—Richard M. Goldberg

(57) ABSTRACT

An exercise machine includes a bench and board section including a stationary bench having first and second opposite ends, and a board having first and second opposite ends, with the first end of the board pivotally mounted adjacent the second end of the stationary bench, each of the bench and board being formed substantially from a single piece which can selectively support a torso of a person and legs of the person, and a resistance device in contact with the single piece board and which applies a resistance to pivotal movement of the board, while permitting the board to swing up and down against a resistance applied by the resistance device.

6 Claims, 37 Drawing Sheets

U.S. PATENT DOCUMENTS 5,951,445 A 9/1999 Vittone
6,015,370 A 1/2000 Pandozy
6,090,022 A * 7/2000 Colecchi ..... 482/131
6,123,653 A 9/2000 Huang
6,168,557 B1 1/2001 Liao
6,224,519 B1 5/2001 Doolittle
6,296,596 B1 10/2001 Alessandri et al.
6,319,178 B1 11/2001 Webber
6,575,884 B1 6/2003 Eazor
6,716,144 B1 * 4/2004 Shifferaw ..... 482/140
2002/0169057 A1 11/2002 Forcillo
2003/0176263 A1 9/2003 Parmater

* cited by examiner

Fig. 24
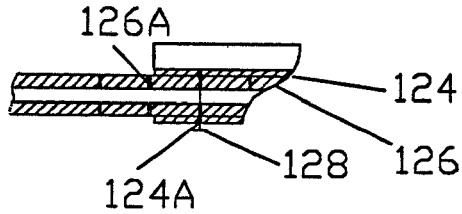
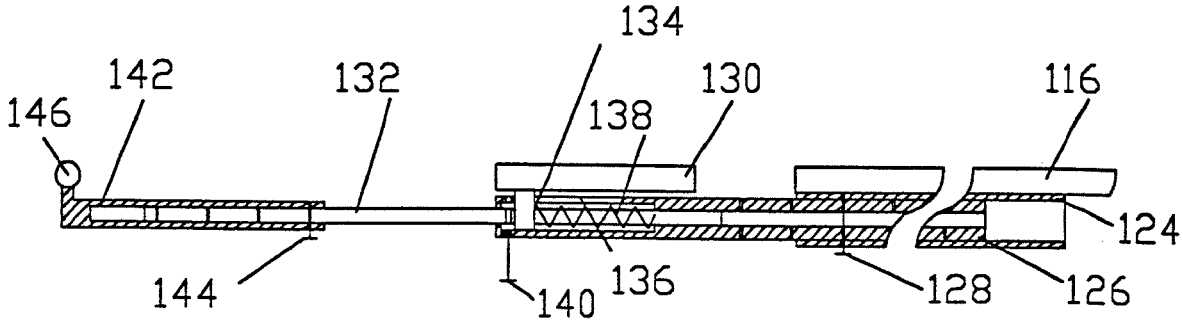
Fig. 23

Fig. 33
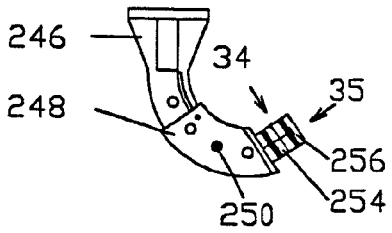
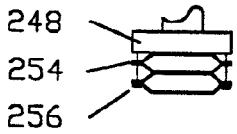
Fig. 34
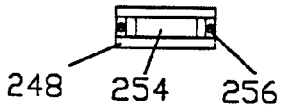
Fig. 35
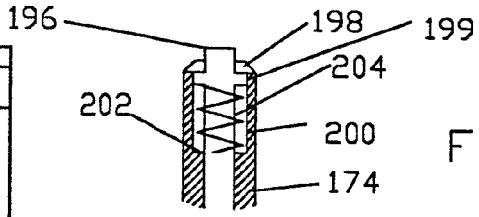
Fig. 31
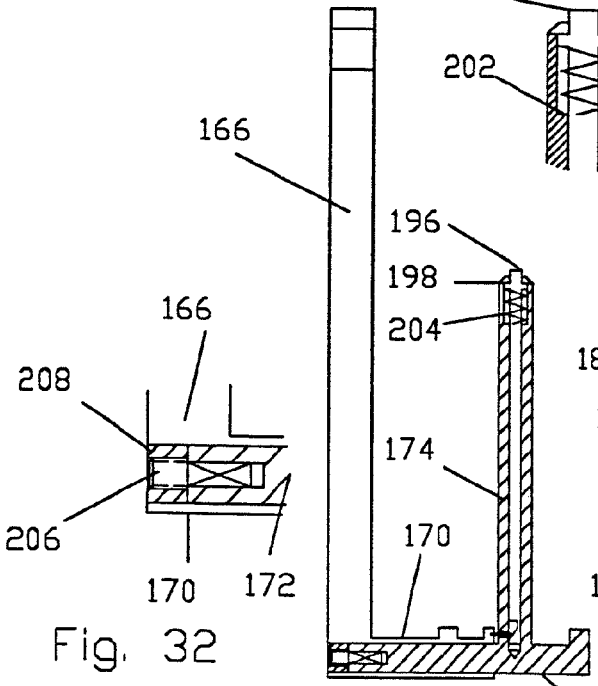
Fig. 29
Fig. 32
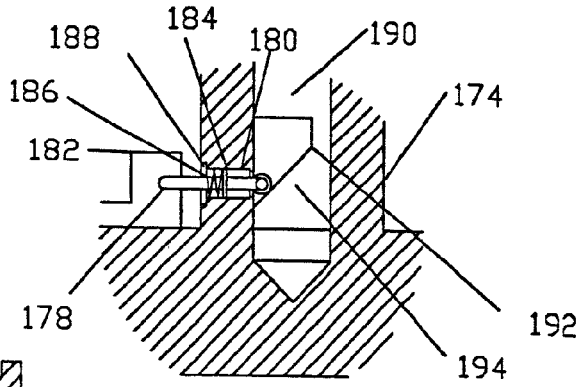
Fig. 30

BEND AND STRETCH ABDOMINAL AND LOWER BACK EXERCISE MACHINE

REFERENCE TO RELATED APPLICATION

The present application claims priority from U.S. Provisional Application No. 60/290,373, filed May 11, 2001.

BACKGROUND OF THE INVENTION

The present invention relates to an abdominal and/or lower back exercise machine and a method for using the same, in which the back and legs of a person are stabilized during an exercise. More particularly, the present invention relates to an exercise machine which facilitates trunk flexion and stretch exercises utilizing sit-up and/or leg-raising motions, without incurring lower back injuries.

Strong abdominal muscles are desirable for health reasons. The benefits not only enhance appearance, but also prevent and reduce lower back problems. Abdominal exercise also can improve the internal circulation of some organs and the back nervous system.

Traditional methods of exercise for strengthening the abdominal muscles are the sit-up exercise or leg raises. Because the upper body or legs are suspended and not supported, there is much wasted energy in raising the head, upper body or legs, with not much energy being directed to the exercise of the abdominal muscles. Many repetitions of sit-ups and leg raises cannot be performed without supporting the head, upper body and legs, so that these exercises are not effective methods for developing strong abdominal muscles.

When the upper body or legs are suspended, the upper body or legs are not supported and the vertebrae have a force applied to them by a torque of the upper body or legs, which can easily result in the development of back injuries. Therefore, these exercises are difficult for most people to perform.

Further, traditional exercise methods only bend, but do not stretch, the abdominal muscles. However, to be effective, exercise methods should stretch the abdominal muscles.

Traditional exercise methods which entail lifting weights by the upper body or legs against gravity easily fatigue the back, leg, and other muscles, and are therefore not good for increasing the back nervous system circulation.

Accordingly, there is a need for a safer and effective method and apparatus for performing abdominal and lower back exercises.

SUMMARY OF THE INVENTION

Accordingly, it is an object of the present invention to provide an exercise machine that overcomes the problems with the aforementioned prior art.

It is another object of the present invention to provide an exercise machine that includes a stationary bench, a board pivotally mounted relative thereto, and a resistance device in contact with the board.

It is another object of the present invention to provide an exercise machine of this type in which each of the bench and board is formed substantially from a single piece which can selectively support a torso of a person or legs of the person.

It is yet another object of the present invention to provide an exercise machine that is easy and economical to use and manufacture.

In accordance with an aspect of the present invention, an exercise machine includes a bench and board section including a stationary bench having first and second opposite ends, and a board having first and second opposite ends, with the first end of the board pivotally mounted adjacent the second end of the stationary bench, each of the bench and board being formed substantially from a single piece which can selectively support a torso of a person and legs of the person, and a resistance device in contact with the single piece board and which applies a resistance to pivotal movement of the board, while permitting the board to swing up and down against a resistance applied by the resistance device.

In a first embodiment, the resistance device includes a stacked weight arrangement and a pulley system connected between the second end of the board and the stacked weight arrangement. The stacked weight arrangement includes at least one bar and a plurality of weights selectively connected with the at least one bar, and the pulley system includes at least one pulley and a cable connected between the at least one bar and the second end of the board, and extending over the at least pulley.

In a second embodiment, the stationary bench and the board are mounted on a frame, and the resistance device includes an axle rotatably mounted to the frame, a lever mounted on the axle and having a free end in contact with an underside of the board, and a weight holder mounted to the axle for holding a plurality of weights such that downward movement of the board causes the axle to rotate through the lever and thereby causes the weight holder to rotate, and release of pressure on the board results in the weight holder returning by gravity to its original neutral position to move the board back to its initial raised position. In this embodiment, there is also an arrangement for varying an angular relation between the lever and the weight holder to adjust the angular position of the board in its initial raised position. In such case, the lever is rotatably mounted on the axle, and the arrangement for varying the angular relation includes a first spline rotatably mounted on the axle and fixed to the lever, a second spline fixedly mounted on the axle adjacent to the first spline, a third outer spline surrounding the first and second splines and in meshing engagement therewith, and a spline removing arrangement for removing the third outer spline from one of the first and second splines to permit rotation of the lever relative to the axle, whereupon when the third spline is moved back over the first and second splines, the angle of inclination of the lever relative to the axle has changed, resulting in the angular position of the board in its initial raised position being changed.

In a third embodiment, the stationary bench and the board are mounted on a frame, and the resistance device includes an axle rotatably mounted to the frame, a lever mounted on the axle and having a free end in contact with an underside of the board, a post fixedly mounted on the axle, a stacked weight arrangement, and a pulley system connected between a free end of the post and the stacked weight arrangement. In such case, the stacked weight arrangement includes at least one bar and a plurality of weights selectively connected with the at least one bar, and the pulley system includes at least one pulley and a cable connected between the at least one bar and the free end of the post, and extending over the at least one pulley. Again, there is further provided an arrangement for varying an angular relation between the lever and the post to adjust the angular position of the board in its initial raised position. In such case, the lever is rotatably mounted on the axle, and the arrangement for varying the angular relation includes a first spline rotatably mounted on the axle and fixed to the lever, a second spline fixedly mounted on the axle adjacent to the first spline, a third outer spline surrounding the first and second splines and in meshing engagement therewith, and a spline removing arrangement for removing the third outer spline from one of the first and second splines to permit rotation of the lever relative to the axle, whereupon when the third spline is moved back over the first and second splines, the angle of inclination of the lever relative to the axle has changed, resulting in the angular position of the board in its initial raised position being changed.

In a fourth embodiment, the stationary bench and the board are mounted on a frame, and the resistance device includes an axle rotatably mounted to the frame, a lever mounted on the axle and having a free end in contact with an underside of the board, and a spiral spring having a first end fixed relative to the frame and a second opposite end connected with the axle. There is further an arrangement for adjusting a position of the first end of the spiral spring relative to the frame. In such case, the arrangement for adjusting includes gear teeth on the frame, a gear rotatably connected with the first end of the spiral spring, a handle for moving the gear along the gear teeth to adjust the position of the first end of the spiral spring, and a securing arrangement for releasably securing the first end of the spiral spring relative to the frame after the gear has been moved along the gear teeth to a desired position.

In a fifth embodiment, the stationary bench and the board are mounted on a frame, and the resistance device includes an axle mounted to the frame, at least one torsion spring mounted on the axle and having a first end fixed relative to the frame, and a second opposite end, and a lever mounted on the second opposite end of the at least one torsion spring and having a free end in contact with an underside of the board.

In a sixth embodiment, the stationary bench and the board are mounted on a frame, and the resistance device includes an axle rotatably mounted to the frame, a first lever fixedly mounted on the axle and having a free end in contact with an underside of the board, a second lever fixedly mounted on the axle and having a free end, the first and second levers being oriented at different angular positions on the axle, and a spring resistance mechanism connected between the frame and the free end of the second lever. The spring resistance mechanism includes at least one compression spring connected with the frame and a spring pusher connected between the at least one compression spring and the free end of the second lever.

In each of the above embodiments, there is preferably also at least one spring loaded stop positioned beneath the board for providing a soft stop of the board when the board is moving downwardly.

Also, the stationary bench and the board are mounted on a frame, and there is further at least one set of arms positionable to sides of the frame that a person can hold onto while exercising.

Further, in some embodiments, there is a double hinge having a first hinge axis that permits the board to pivotally move relative to the stationary bench and a second hinge axis that permits the board to pivot in parallel relation directly above the stationary bench.

The above and other objects, features and advantages of the invention will become readily apparent from the following detailed description thereof which is to be read in connection with the accompanying drawings.

BRIEF DESCRIPTION OF THE DRAWINGS

FIG. 23 is a cross-sectional view of a portion of the exercise machine of FIG. 22, showing the connection of the bench, bench extension and holder;

FIG. 24 is an enlarged cross-sectional view of a portion of FIG. 23, showing the locking arrangement of the square tubes;

FIG. 29 is an enlarged cross-sectional view showing the weight holder for holding stacked weights;

FIG. 30 is an enlarged cross-sectional view of a portion of the weight holder, showing the latch pin arrangement for maintaining the post in a vertical orientation;

FIG. 31 is an enlarged cross-sectional view of a portion of the weight holder, showing the push button arrangement for releasing the latch button;

FIG. 32 is an enlarged cross-sectional view of a portion of the weight holder, showing the latch arrangement therefor;

FIG. 33 is a side elevational view, showing the board swing down angle adjuster;

FIG. 34 is an enlarged elevational view of the board swing down angle adjuster, viewed from arrow 34;

FIG. 35 is an enlarged plan view of the board swing down angle adjuster, viewed from arrow 35;

DETAILED DESCRIPTION

First Embodiment

Figure 1:
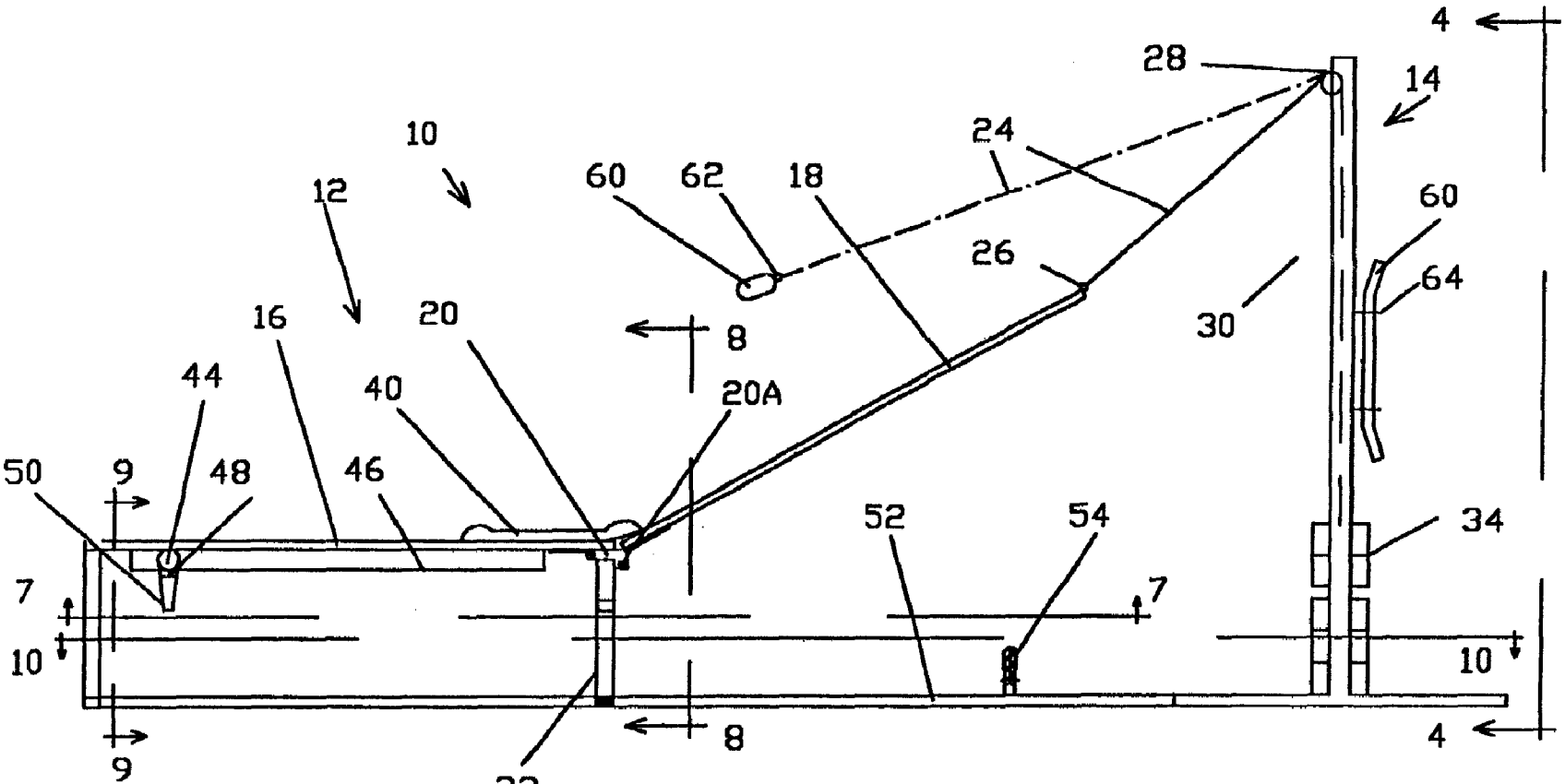
FIG. 1 is a side elevational view of an exercise machine according to a first embodiment of the invention.
Figure 2:
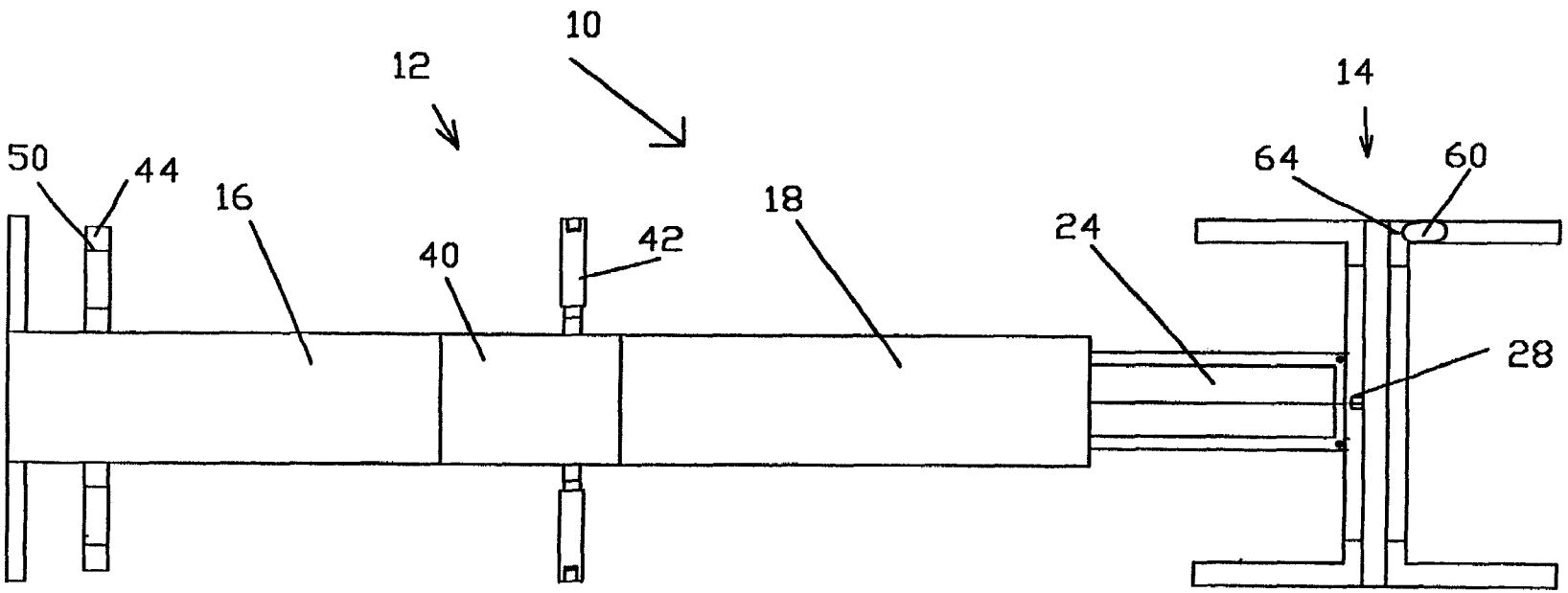
FIG. 2 is a top plan view of the exercise machine of FIG. 1.
Figure 3:
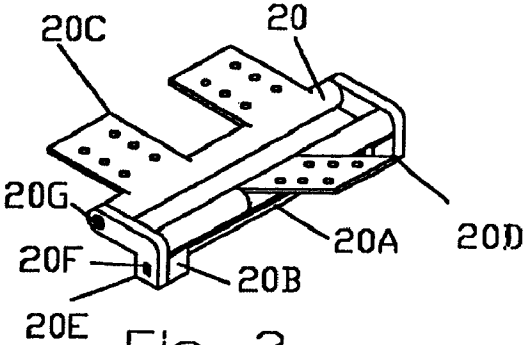
FIG. 3 is an enlarged perspective view of the double hinge.

Referring to the drawings, and initially to FIGS. 1 to 11 which illustrate a first embodiment of the invention, an exercise machine 10 includes a bench and board section 12 comprised of a stationary bench 16 and a board 18 pivotally hinged at one end to an end of bench 16 by double hinges 20 shown best in FIG. 3. As shown, one side 20C of double hinges 20 is mounted to the underside at one end of bench 16, and the opposite side 20D is mounted to the underside at one end of board 18. Hinge 20 includes two downwardly extending ears 20E near board side 20D, each ear 20E being aligned to the outside of a ring 20B extending down from bench 16. Ears 20E and rings 20B have aligned holes 20F through which a metal rod 20A extends for further stabilizing hinge 20 in order to maintain hinge 20 tight against the legs of bench 16 during an exercise. Hinge 20 permits board 18 to be pivoted to a position above the horizontal with respect to bench 16 and below the horizontal with respect to bench 16, as will be understood better from the description hereinafter.

Figure 11:
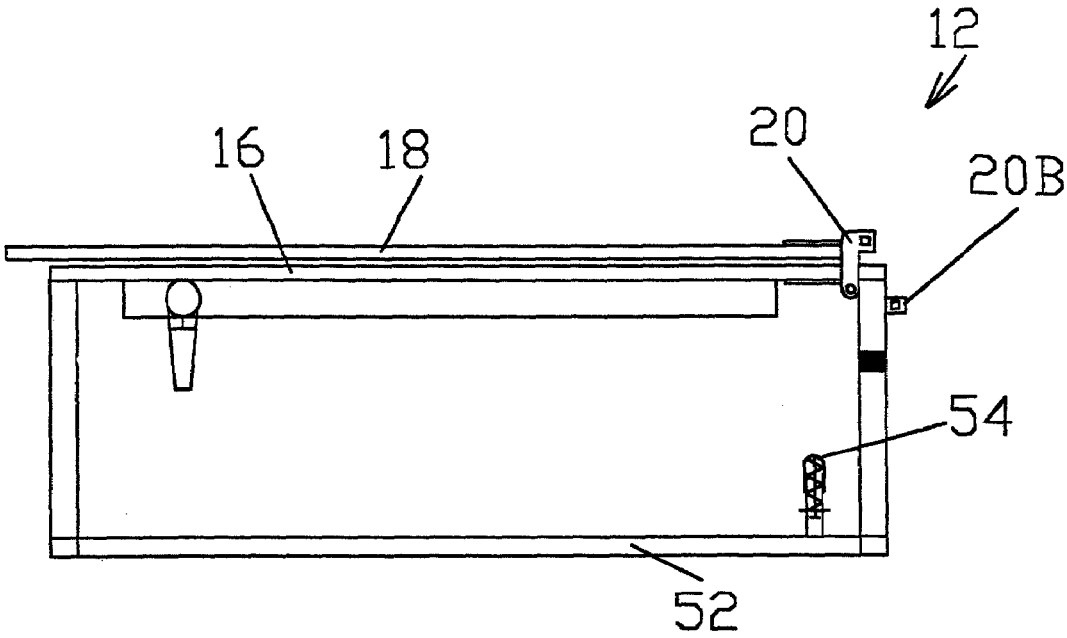
FIG. 11 is a side elevation view showing the exercise machine in a closed position.
Figure 5:
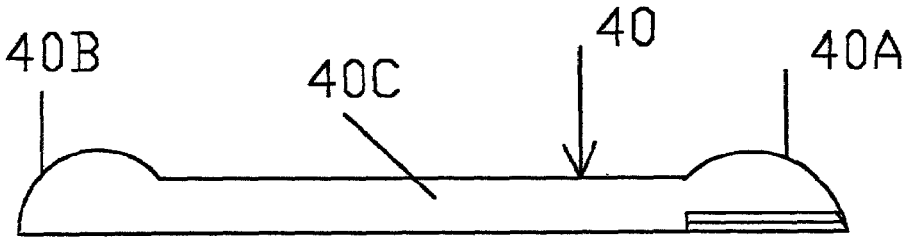
FIG. 5 is an enlarged side elevational view of the pad in the regular exercising position that covers the gap between the bench and the board.
Figure 6:
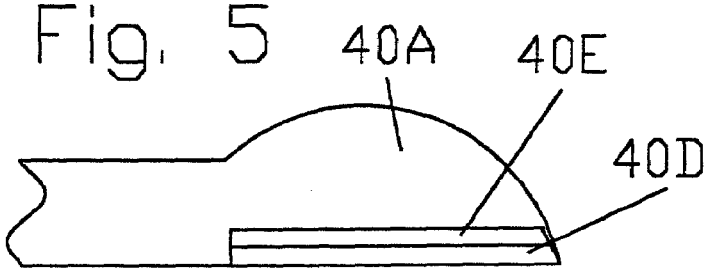
FIG. 6 is an enlarged side elevational view of one end of the pad of FIG. 5.
Figure 8:
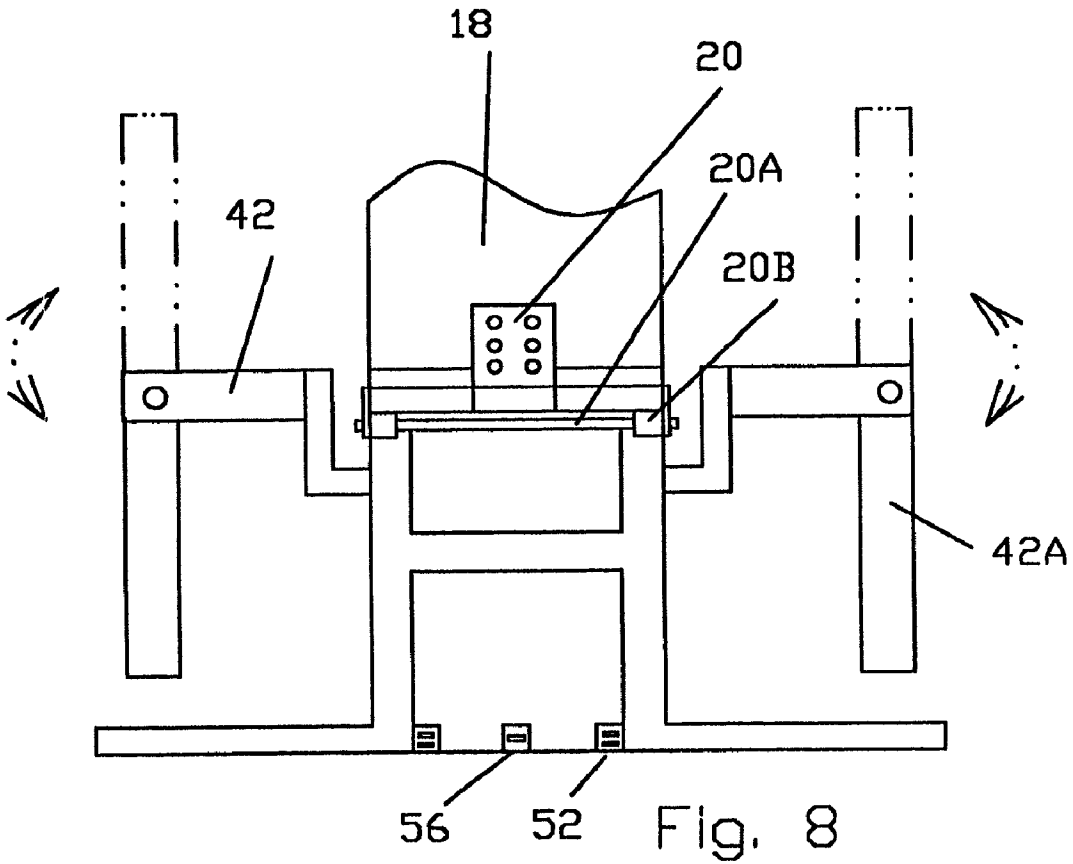
FIG. 8 is an enlarged cross-sectional view of FIG. 1, taken along line 8-8 thereof.
Figure 9:
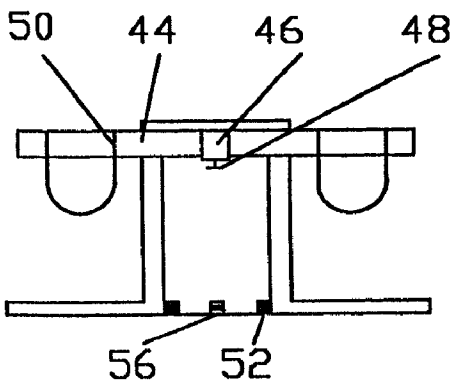
FIG. 9 is a cross-sectional view of FIG. 1, taken along line 9-9 thereof.

In addition, when metal rod 20A is removed, hinge 20 can pivot about a hinge pin 20G (FIG. 3) at the bench side, as shown in FIG. 11, for positioning board 18 on top of stationary bench 16 for storage. Bench 16 is supported on legs 22, as is conventional, at the front and rear of bench 16.

Exercise machine 10 further includes a pulley system 14 for controlling raising and lowering of the opposite end of board 18 of bench and board section 12. In this regard, the opposite end of board 18 is connected to one end of a cable 24 of pulley system 14 by a hook 26. Cable 24 travels from board 18 over a pulley 28 mounted centrally at the upper end of a rectangular vertically oriented frame 30. The opposite end of cable 24 is connected to a vertical bar 32 having a plurality of holes (not shown) and on which a plurality of stacked weight plates 34 are positioned, each stacked weight plate 34 having a transverse hole 36. In this manner, a pin 32A, as is conventional, can be inserted through a hole 36 to connect the respective weight plate 34 to vertical bar 32. Accordingly, when cable 24 pulls vertical bar 32 upwardly, the connected weight plate 34, and all weight plates 34 situated thereabove, are raised. In this regard, each weight plate 34 is also slidably positioned on two vertical bars 38 connected to frame 30 for guiding the same.

In order to provide comfort to a person utilizing exercise machine 10, a pad 40 is mounted on exercise machine 10 between bench 16 and board 18. As shown best in FIGS. 1, 5 and 6, pad 40 has two bulbous ends 40A and 40B connected by a relatively flat section 40C. Bulbous end 40A has two additional layers at the lower surface thereof, namely, a rubber layer 40D and a piece of semi-flexible material 40E. Pad 40 is provided for keeping the body comfortable, protecting the body, and preventing the body from sinking into the slot between bench 16 and board 18. Rubber layer 40D and semi-flexible material 40E are on top of the slot between bench 16 and board 18, to prevent pad 40 from sinking into the slot, as shown in FIGS. 1 and 2.

Holding bars 42 are mounted to legs 22 of bench 16 adjacent board 18, for holding onto by a person while performing exercises, thereby preventing the body of the person from slipping on bench 16. Sit up holders 42A are pivotally provided at the free ends of holding bars 42 for helping a person sit up after the person has lain down during an exercise. Holders 42A can swing up, as shown by the dot-dash lines in FIG. 8. When exercise machine 10 is not in use, sit up holders 42A swing down to the solid line position in FIG. 8.

Figure 7:
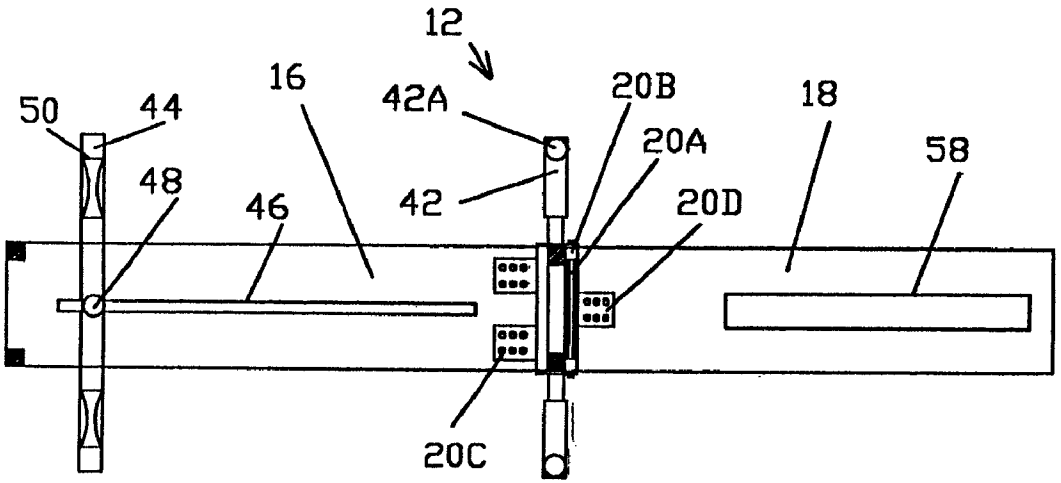
FIG. 7 is a cross-sectional view of FIG. 1, taken along line 7-7.
Figure 10:
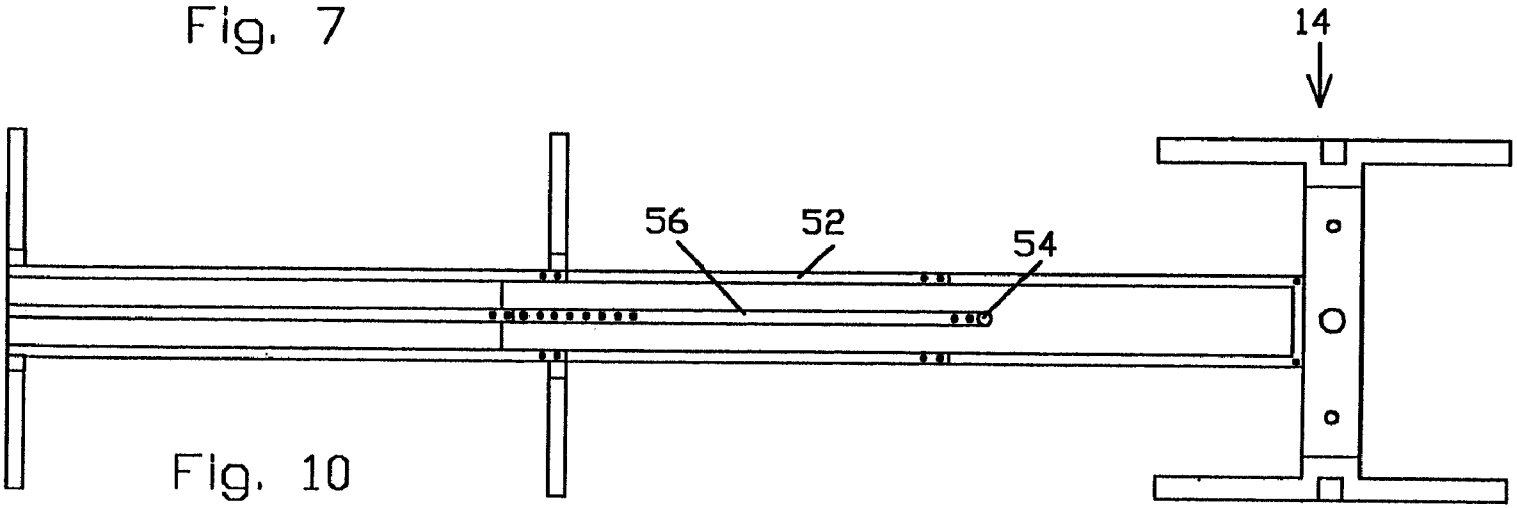
FIG. 10 is a cross-sectional view of FIG. 1, taken along line 10-10 thereof.
Figure 4:
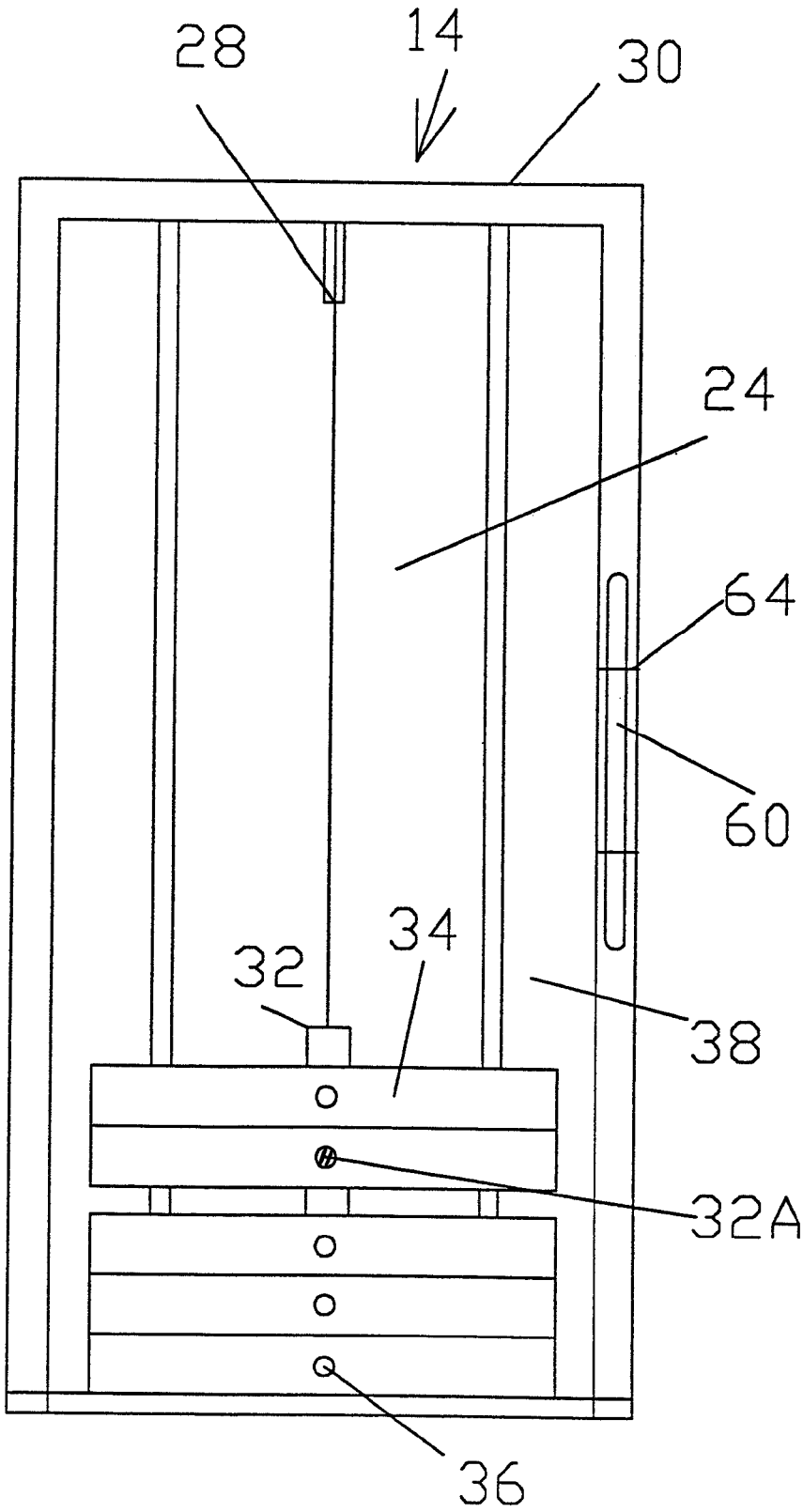
FIG. 4 is an end elevational view of the exercise machine of FIG. 1, viewed from line 4-4.

Further, another horizontally oriented bar 44 that extends out from both sides of bench 16, can slide in a sliding track 46 provided at the underside of bench 16, and can be releasably fixed at a desired position in sliding track 46 by a tightening pin or bolt 48, as best shown in FIG. 7. In this manner, a person can hold onto bar 44 while performing exercises. Foot straps 50 are connected to the ends of bar 44 and can swing around bar 44. Alternatively, a single foot belt or single foot strap for both feet can be used in place of the two foot straps 50. When foot straps 50 are positioned under bar 44, a person holds onto bar 44 as a holding bar, and when foot straps 50 are moved above bar 44, a person's feet can fit in foot straps 50 when the person is lying down on bench 16 and performing exercises.

Another sliding track 52 is provided on the ground for connecting bench and board section 12 and pulley system 14. In this regard, bench and board section 12 is mounted on sliding track 52. Thus, while a person is performing an exercise, sliding track 52 is in extended or longest position and the distance between bench and board section 12 and pulley system 14 is at a predetermined distance. However, when sliding track 52 is pushed in completely, sliding track 52 is positioned entirely under bench 16 and exercise machine 10 is closed, as shown in FIG. 11.

As previously discussed, board 18 can pivot down to a position below a horizontal position with respect to bench 16, and in fact, can touch the ground. In this regard, a stop spring 54 is mounted on a sliding track 56 mounted under bench 16 and can elongate to adjust the length thereof and the position of stop spring 54 with respect to the free end of pivoting board 18. Stop spring 54 thereby helps board 18 stop slowly. When sliding track 56 is pushed in completely, stop spring 54 is positioned under bench 16. A stop spring plate 58 is mounted under board 18 for protecting board 18 from any possible damage from impacting against stop spring 54.

Figure 12:
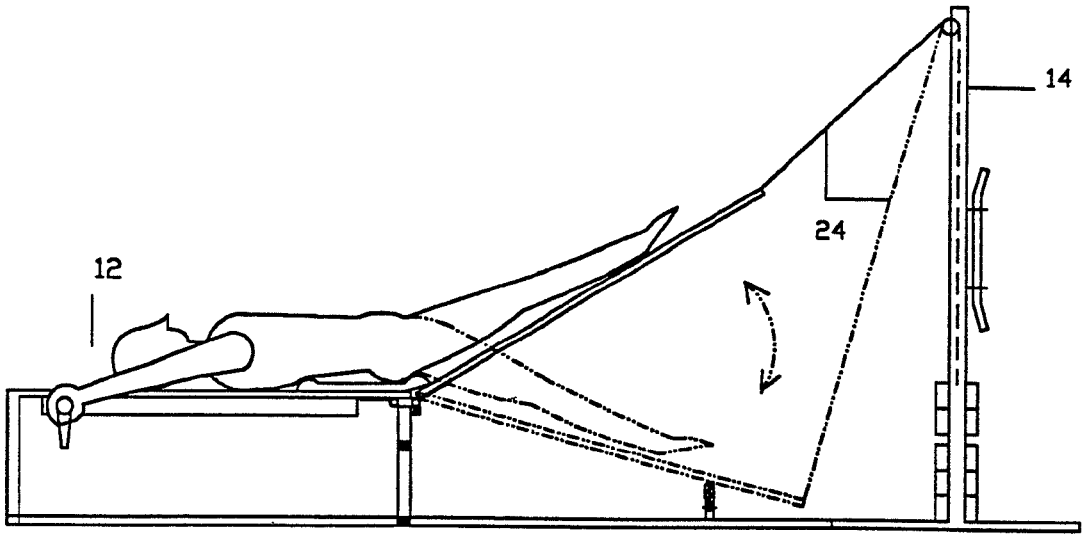
FIG. 12 is a side elevational view showing a person lying on his or her back on the bench and board section such that the person's torso is on the bench and the person's legs are on the pivotal board.
Figure 13:
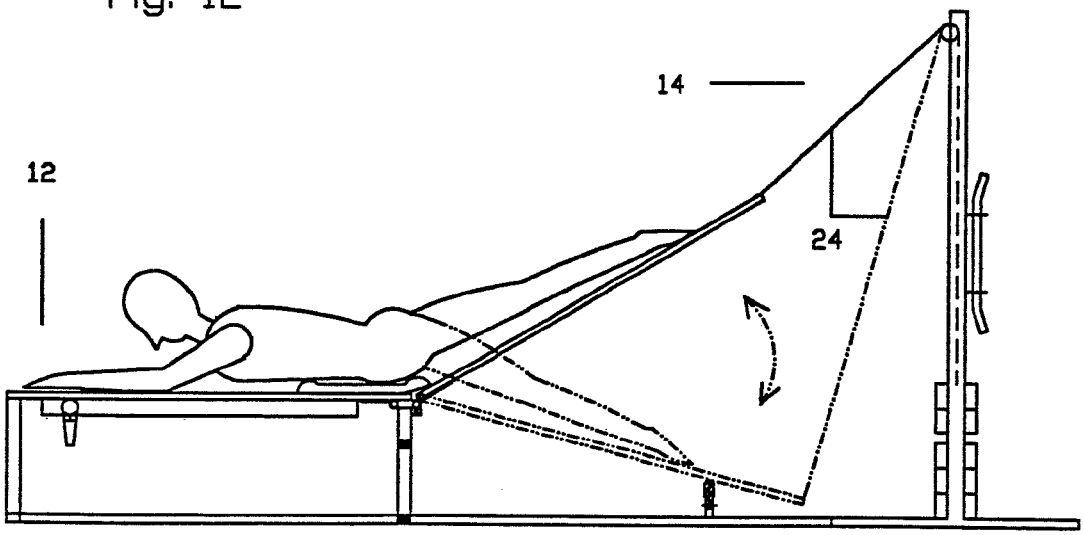
FIG. 13 is a side elevational view showing a person lying on his or her stomach on the bench and board section such that the person's torso is on the bench and the person's legs are on the pivotal board.
Figure 14:
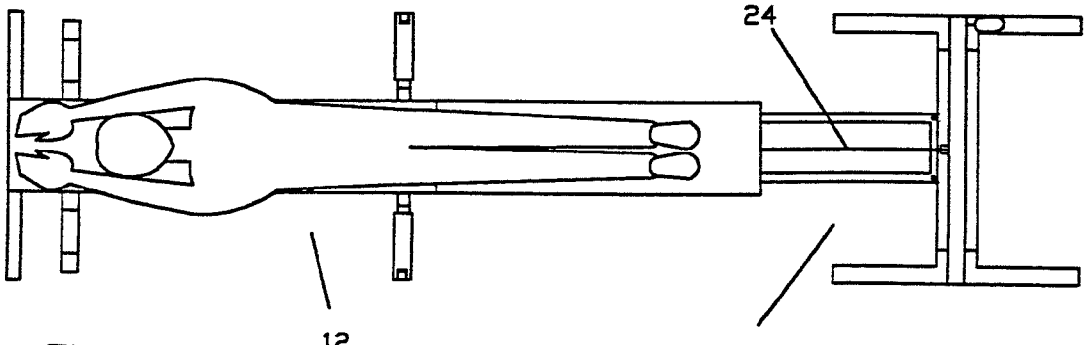
FIG. 14 is top plan view of FIG. 13.

With the above arrangement, as a person pushes down on board 18, board 18 pivots downwardly about hinges 20, as shown by the dashed line position in FIG. 12, against the resistance of stacked weight plates 34. When the person releases the pushing down force, stacked weight plates 34, through cable 24, raise board 18 to the solid line position in FIG. 12. It will be appreciated that the person can lie on his or her back, as shown in FIG. 12, or on his or her stomach, as shown in FIGS. 13 and 14, to perform the exercises, thereby exercising different muscles.

Figure 15:
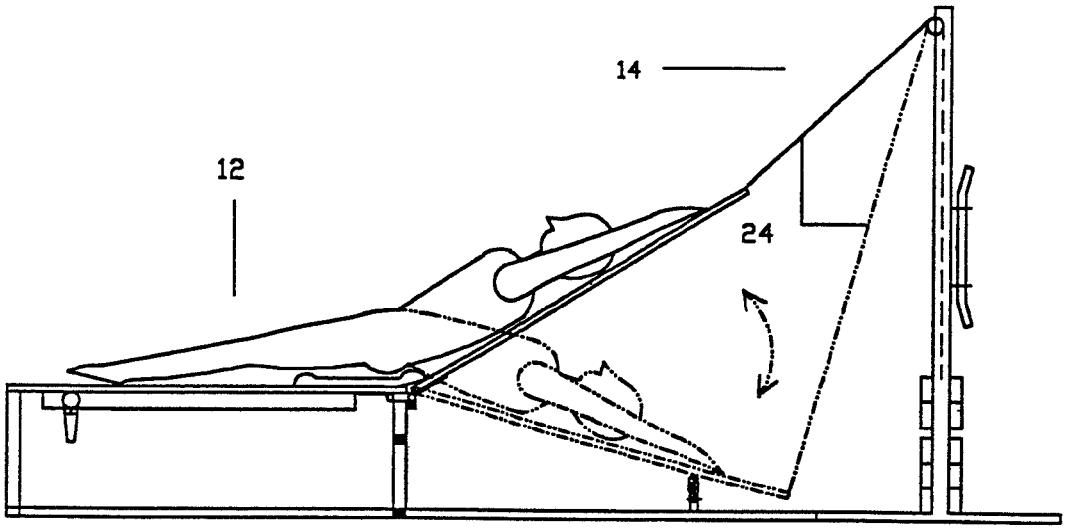
FIG. 15 is a side elevational view showing a person lying on his or her back on the bench and board section such that the person's legs are on the bench and the person's torso is on the pivotal board.
Figure 16:
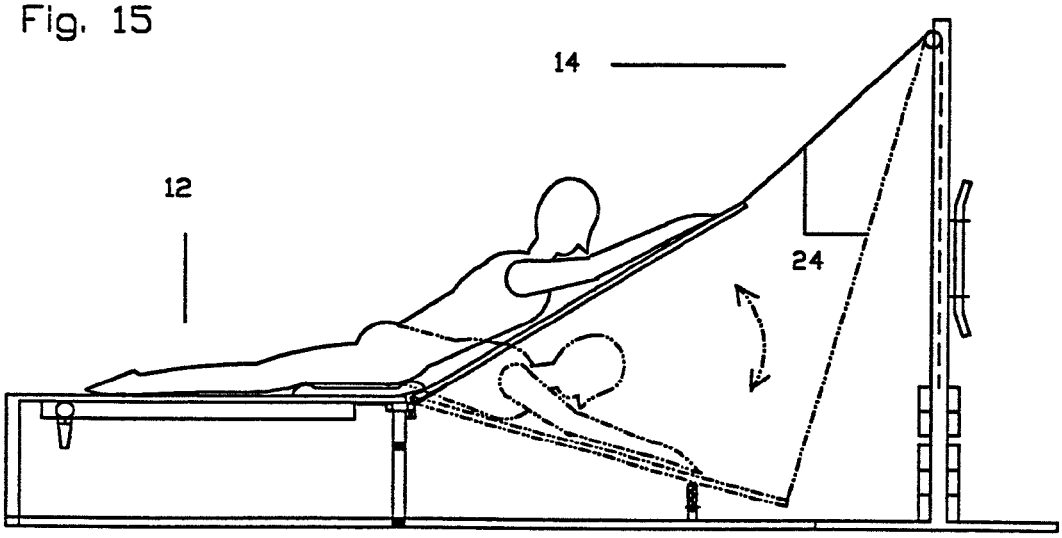
FIG. 16 is a side elevational view showing a person lying on his or her stomach on the bench and board section such that the person's legs are on the bench and the person's torso is on the pivotal board.
Figure 17:
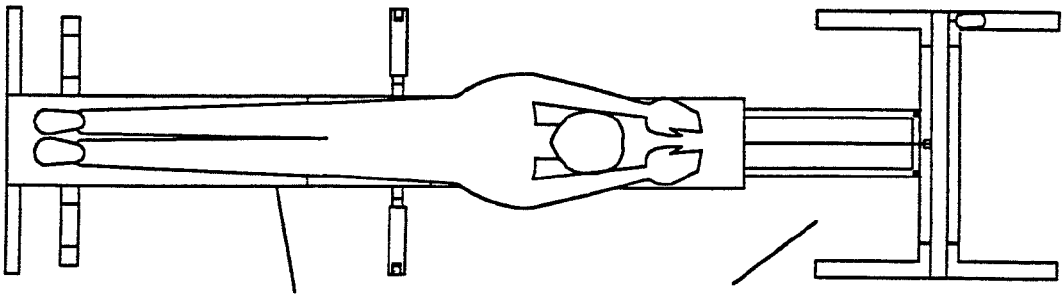
FIG. 17 is top plan view of FIG. 16.

Further, rather than the person's torso on bench 16 and the person's legs on board 18, the reverse can occur, as shown in FIGS. 15-17, for performing still different exercises.

Figure 18:
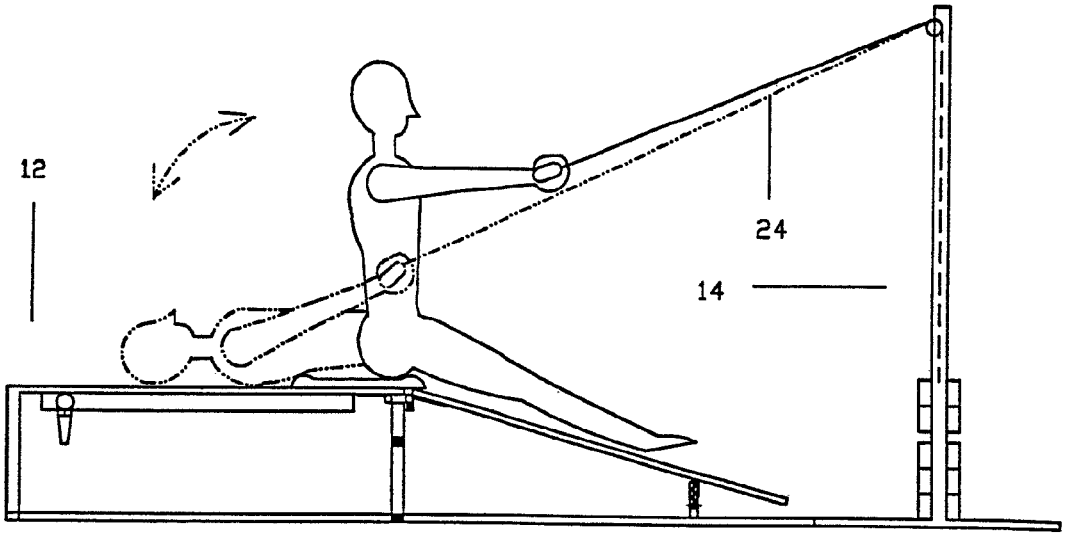
FIG. 18 is a side elevational view of a modification of the first embodiment of the present invention in which the cable is disengaged from the board and showing a person exercising therewith.
Figure 19:
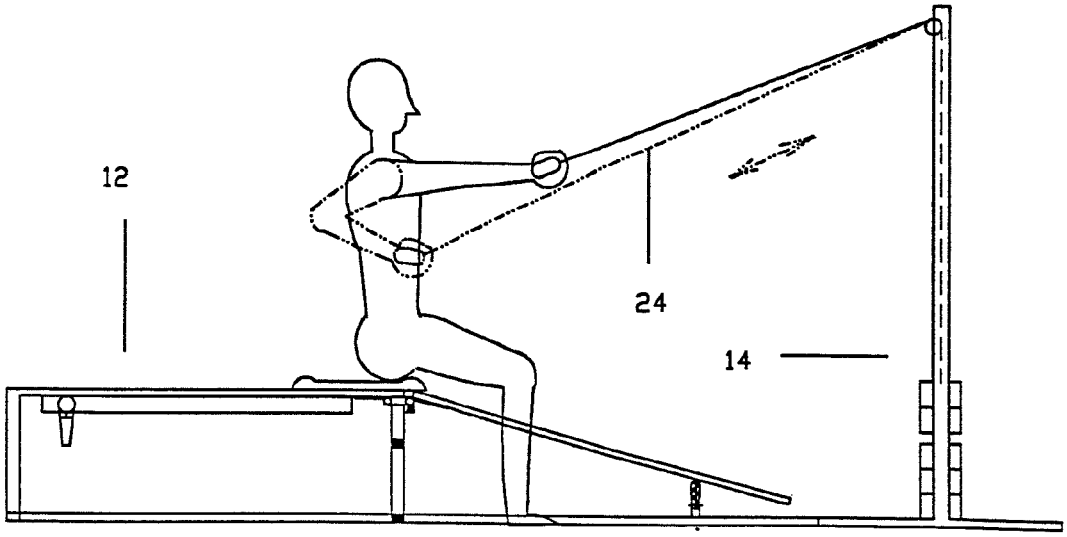
FIG. 19 is a side elevational view of the modification of FIG. 18, showing a person performing a different exercise therewith.

It will be appreciated that various modifications can be made to exercise machine 10. For example, rather than one end of cable 24 being connected to the free end of board 18, it can be disengaged therefrom and connected to a pulling bar 60 by means of a hook 62. Thus, a person can perform exercises, as shown in FIGS. 18 and 19, by sitting on bench and board section 12 and pulling on pulling bar 60 to raise and lower stacked weight plates 34. When not in use, pulling bar 60 can be stored in a holder 64 on vertically oriented frame 30.

Further, cable 24 can include a plurality of holes (not shown) in different positions for connecting hook 26 or 62. When hook 26 connects to different positions on cable 24, board 18 will be raised up at different angles. Further, with this arrangement, hook 62 can connect to different positions on cable 24 for people of different heights.

Figure 20:
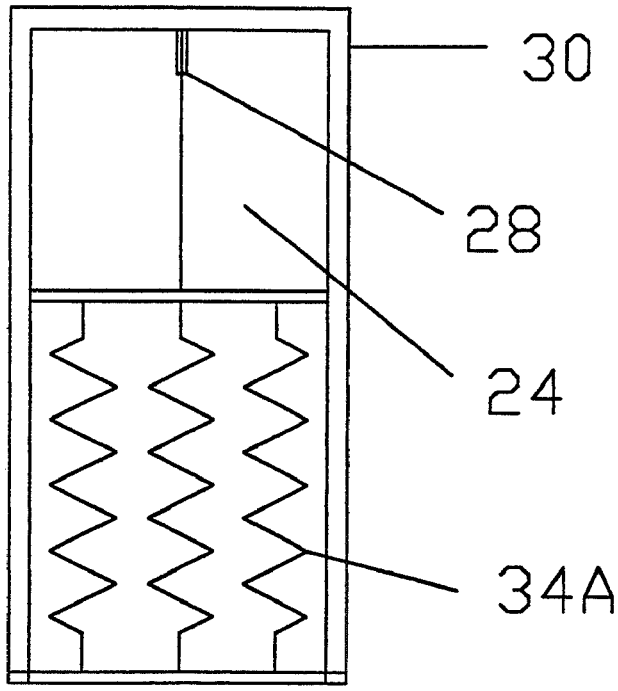
FIG. 20 is an elevational view of a modification of the first embodiment in which a different resistance means is used.
Figure 21:
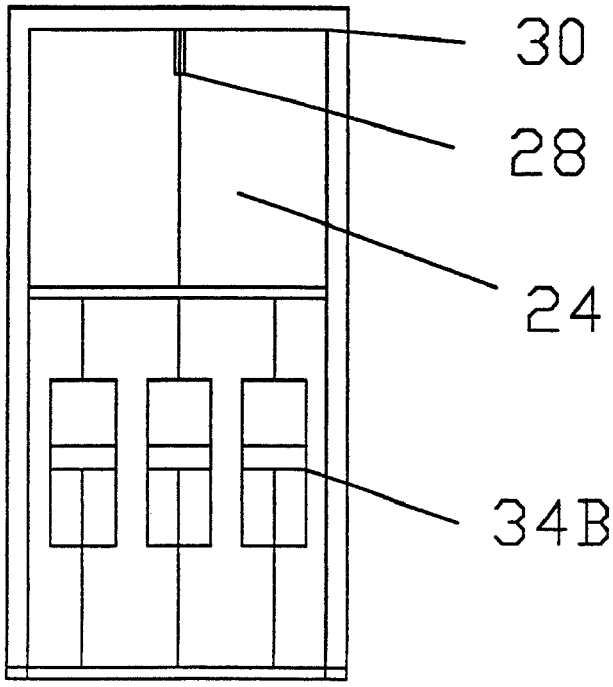
FIG. 21 is an elevational view of a modification of the first embodiment in which a still different resistance means is used.

As a further modification, stacked weight plates 34 can be replaced with other resistance means, such as tension springs 34A, as shown in FIG. 20, compression piston-cylinders 34B, as shown in FIG. 21, elastomer materials or the like.

Second Embodiment

Referring now to FIGS. 22-35, an exercise machine 110 according to a second embodiment of the present invention will now be described in which the resistance means is provided directly on the bench and board section, rather than through a pulley system. Specifically, exercise machine 110 includes a bench and board section 112 comprised of a stationary bench 116, and a board 118 pivotally hinged at one end to a first end of bench 116 by a conventional single hinge. The hinge permits board 118 to be pivoted to a position above the horizontal with respect to bench 116 and below the horizontal with respect to bench 116, as will be understood better from the description hereinafter. Bench 116 is supported on legs 122, as is conventional, at the front and rear of bench 116, and legs 122 are in turn connected to a lower frame 123.

As shown best in FIGS. 23 and 24, a square tube 124 is fixedly connected to the underside of the second, opposite end of bench 116, and a square tube 126 is telescopically received in square tube 124 and extends outwardly therefrom past the end of bench 116. Square tube 124 has a single hole 124A therein and square tube 126 has a plurality of holes 126A therein, each of which can align with hole 124A in square tube 124. A pin or bolt 128 can extend through these holes to releasably lock square tube 126 in a desired longitudinal position with respect to bench 116. A bench extension 130 is mounted on the free end of tube 126 at the same height as bench 116, and is moved with square tube 126 as it is adjusted in square tube 124.

A rod 132 slidably extends within square tube 126 for a short sliding distance therein, to permit movement of a person's legs while performing exercises, but is restrained from escaping from square tube 126. Rod 132 includes a projection 134 thereon which slides within a slot 136 in square tube 126, and a coil spring 138 positioned in square tube 126 abuts against projection 134 to normally bias rod 132 in a direction out of square tube 126. A pin 140 can be provided in square tube 126 to lock rod 132 in a desired position, that is, to prevent sliding movement thereof. Alternatively, pin 140 can be removed entirely to provide a sliding adjustment movement during an exercise.

A holder 142 adjustably mounts to the other end of rod 132 by a pin 144 so that the length thereof can be adjusted, and includes a grip 146 at the free end of holder 142 and extending transversely thereto.

A square tube 148, board extension 150, rod 152 and holder 154 connect to board 118 in the same manner as square tube 126, bench extension 130, rod 132 and holder 142 connect to bench 116, but extending in the opposite direction.

Further, there are preferably pads (not shown) covering bench extension 130, bench 116, board 118, and board extension 150.

Figure 22:
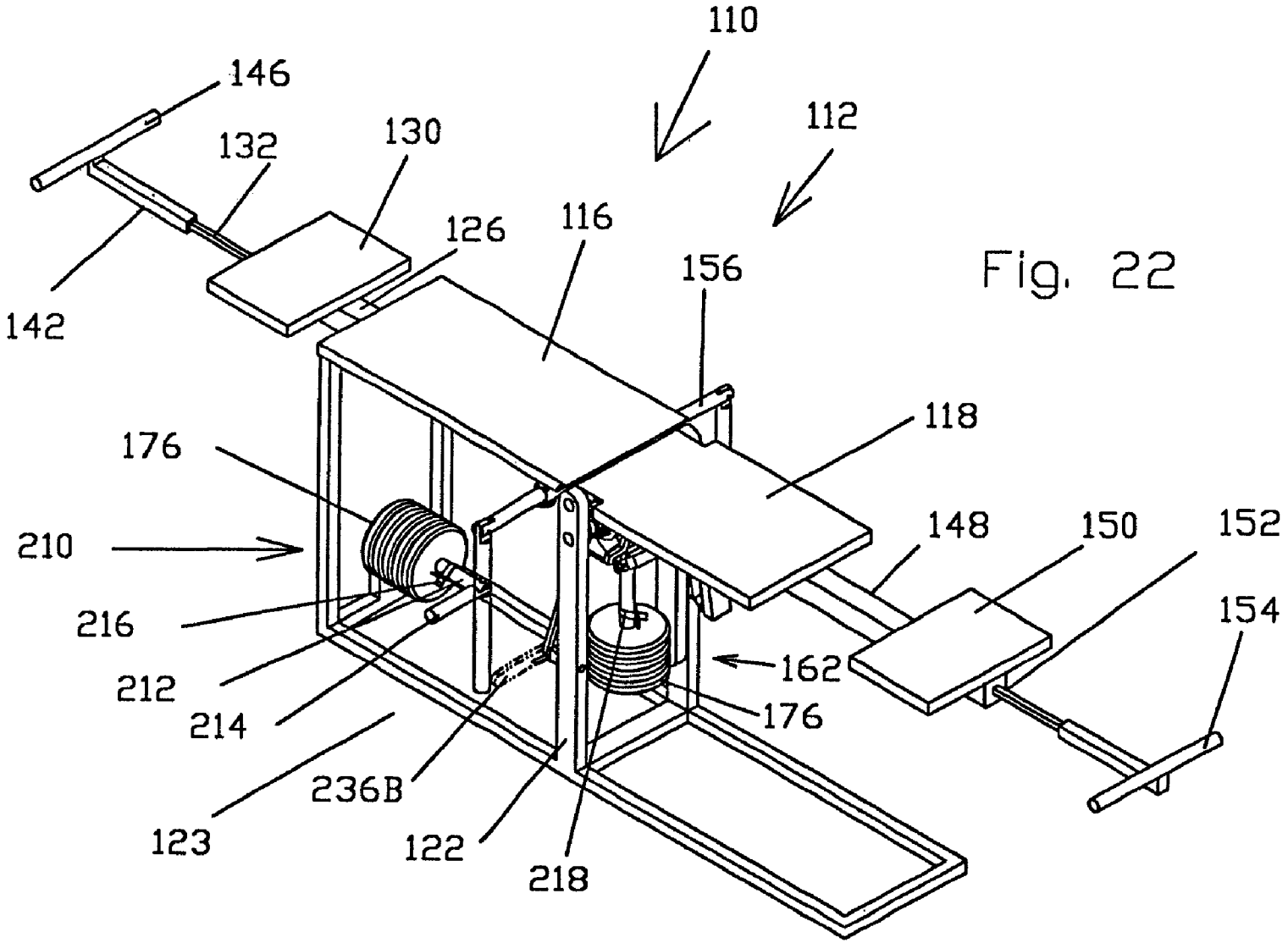
FIG. 22 is a perspective view of an exercise machine according to a second embodiment of the invention.
Figure 27:
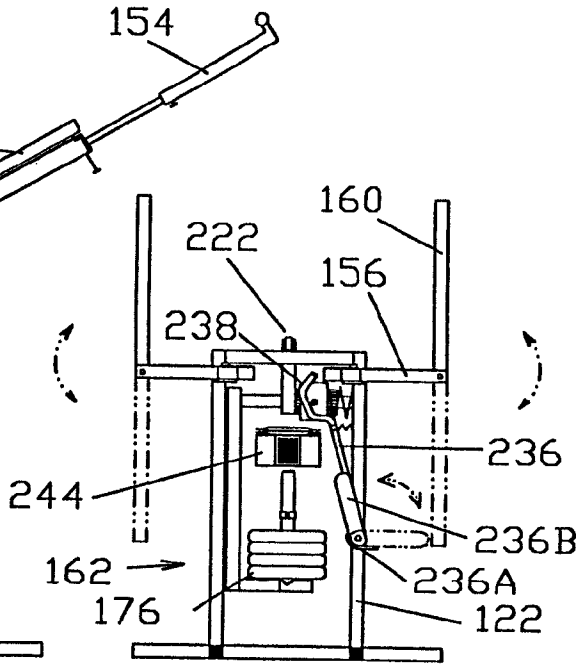
FIG. 27 is a cross-sectional view of FIG. 25, taken along line 27-27 thereof.
Figure 25:
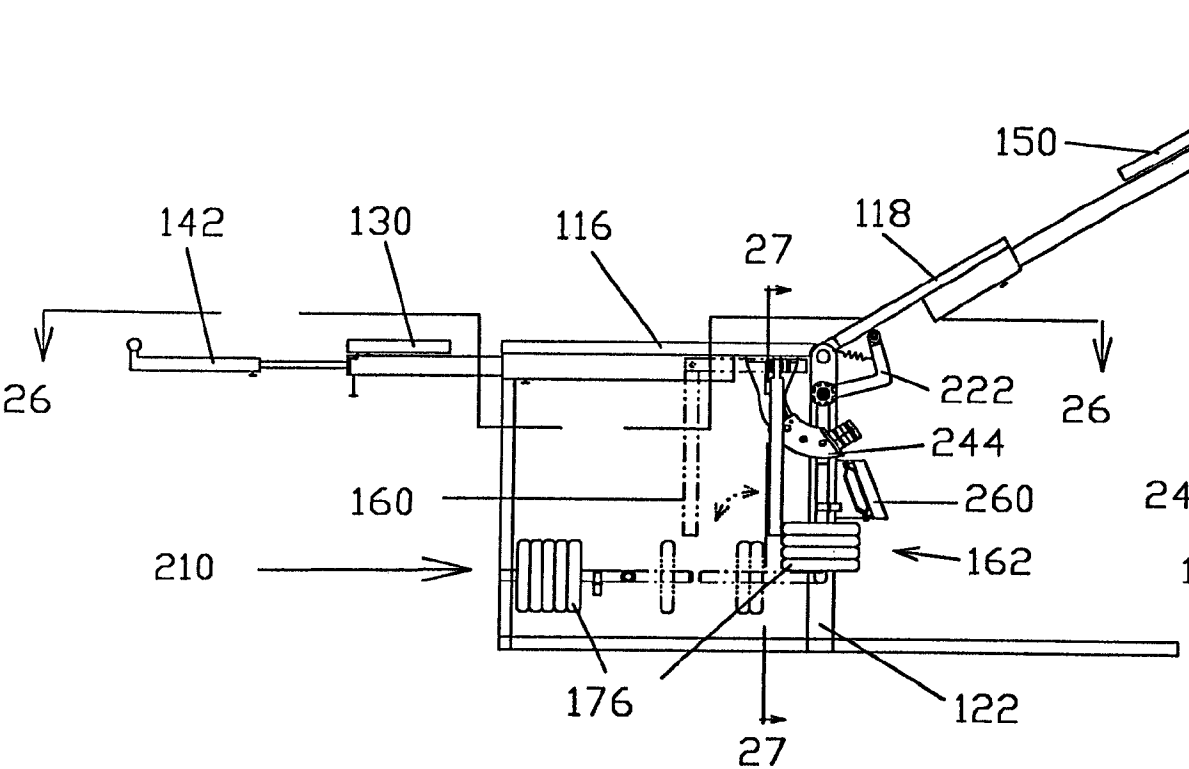
FIG. 25 is a side elevational view of the exercise machine of FIG. 22.
Figure 26:
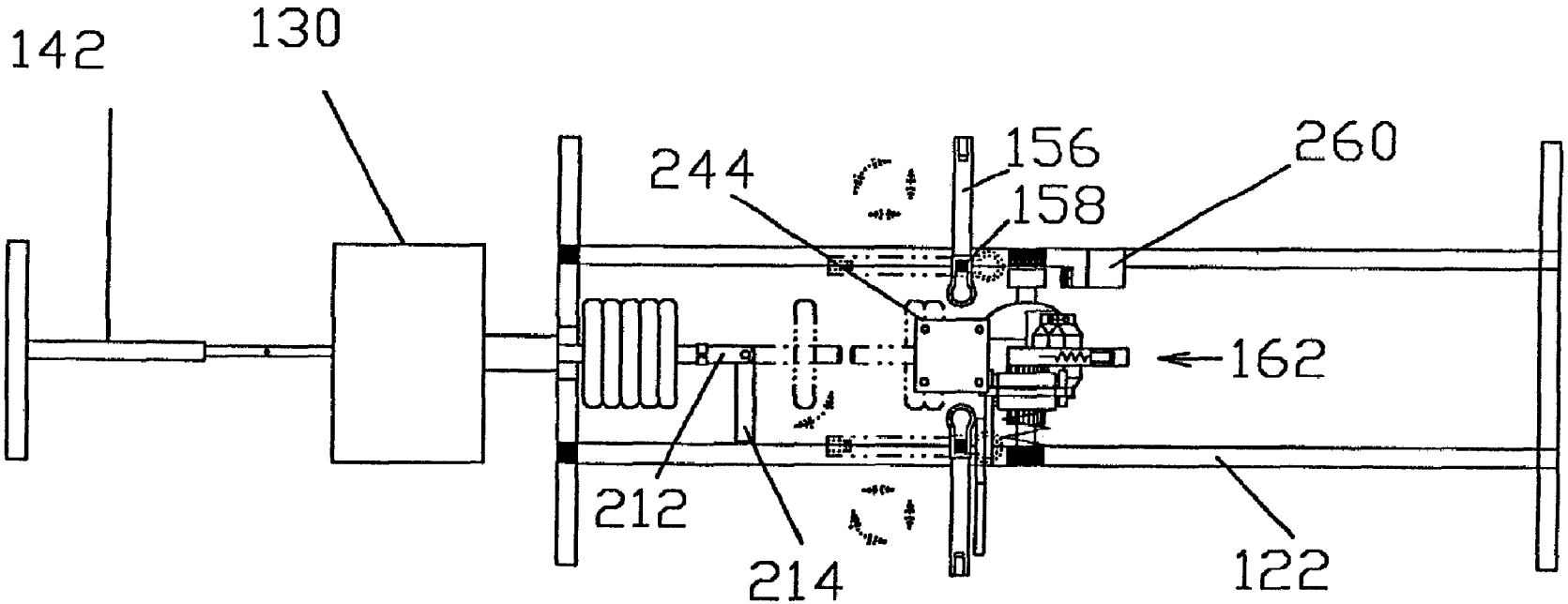
FIG. 26 is a cross-sectional view of FIG. 25, taken along line 26-26 thereof.
Figure 28:
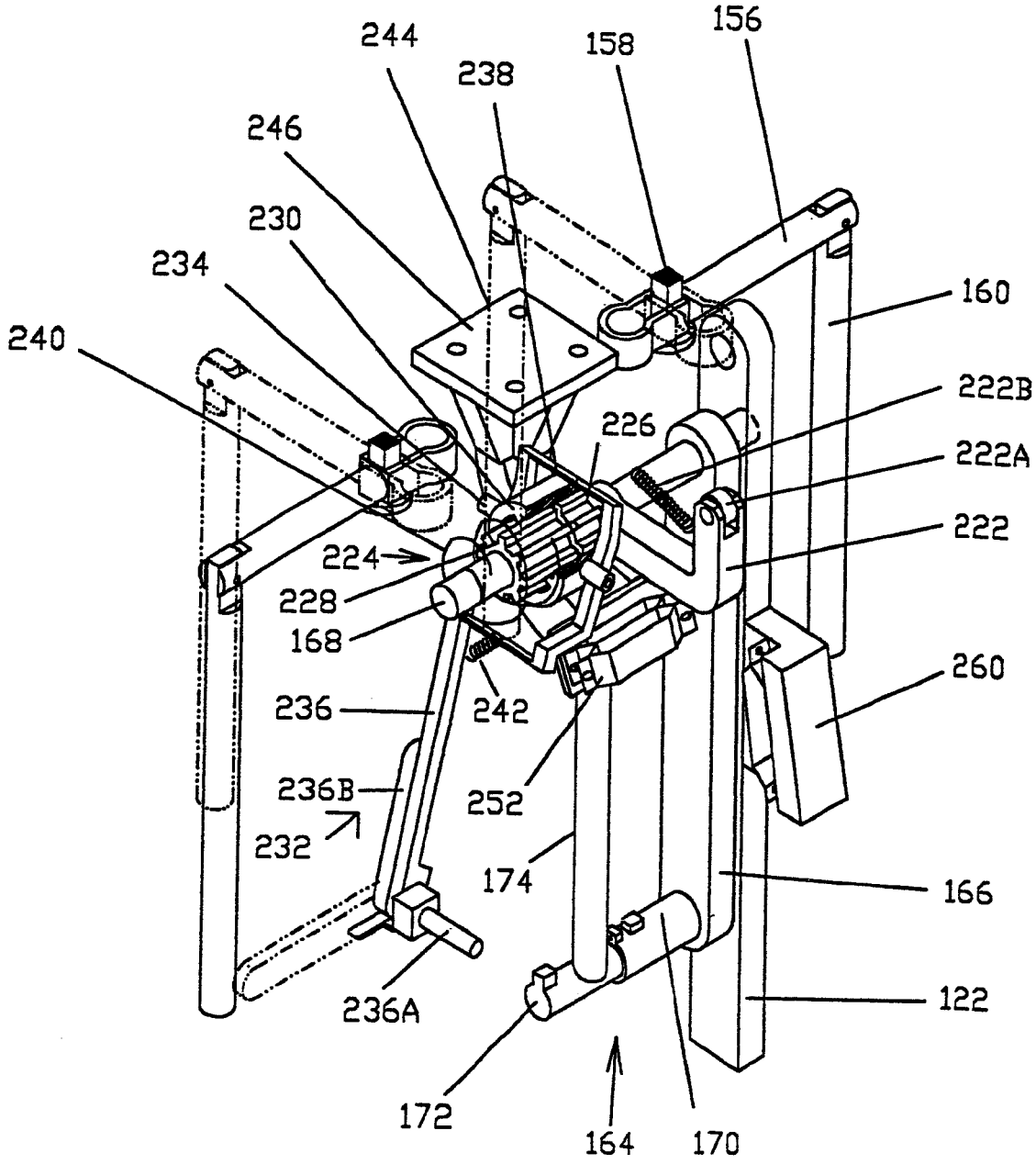
FIG. 28 is a perspective view of the raising device including weight holder, board raise angle adjuster, board swing down angle adjuster and side holders of the exercise machine of FIG. 22.
Figure 36:
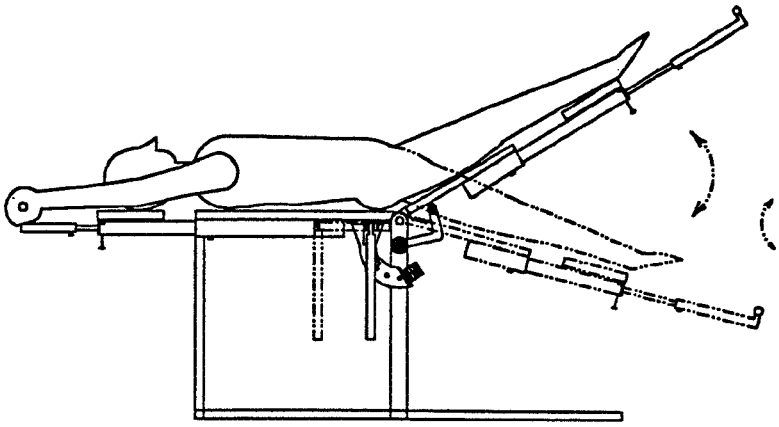
FIG. 36 is a side elevational view showing a person lying on his or her back on the bench and board section of the exercise machine of FIG. 22, such that the person's torso is on the bench and the person's legs are on the pivotal board.
Figure 39:
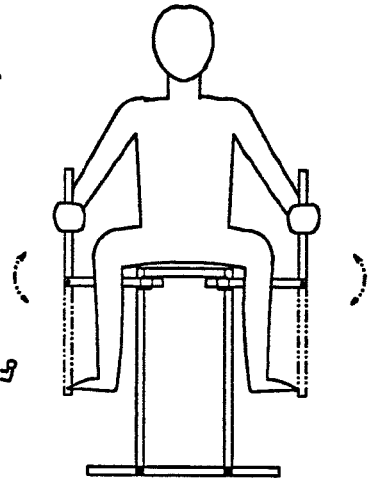
FIG. 39 is an end elevational view of the exercise machine of FIG. 22, showing a person using the sit up holders thereof.
Figure 37:
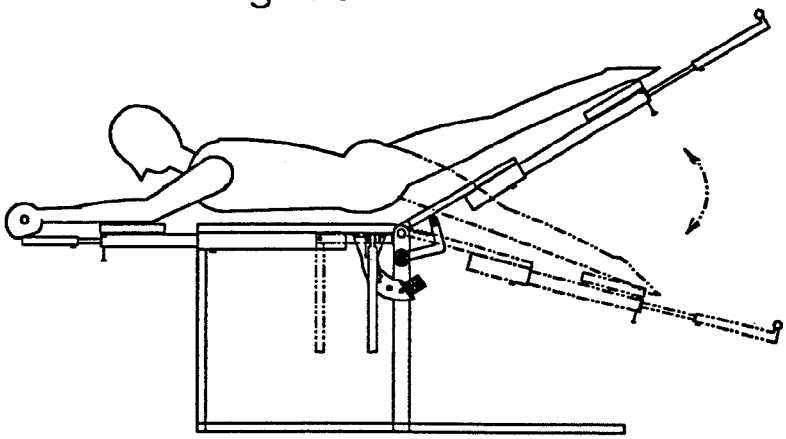
FIG. 37 is a side elevational view showing a person lying on his or her stomach on the bench and board section of the exercise machine of FIG. 22, such that the person's torso is on the bench and the person's legs are on the pivotal board.
Figure 38:
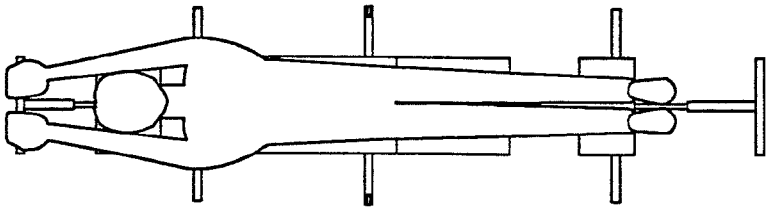
FIG. 38 is top plan view of FIG. 37.
Figure 40:
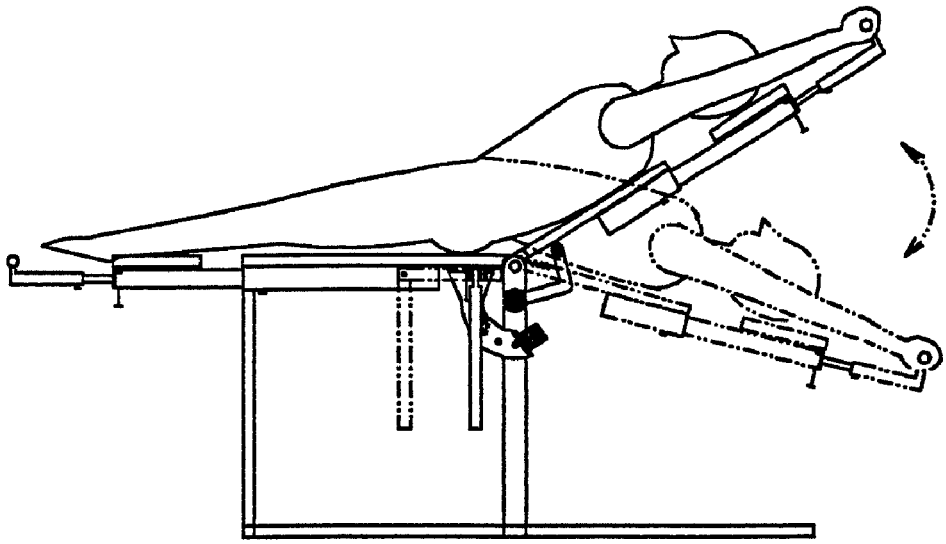
FIG. 40 is a side elevational view showing a person lying on his or her back on the bench and board section of the exercise machine of FIG. 22 such that the person's legs are on the bench and the person's torso is on the pivotal board.
Figure 41:
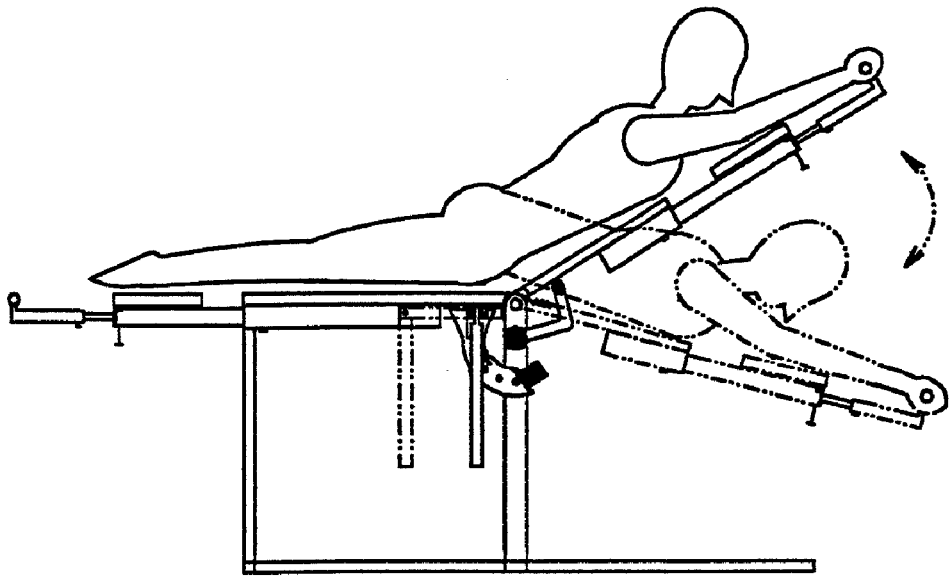
FIG. 41 is a side elevational view showing a person lying on his or her stomach on the bench and board section of the exercise machine of FIG. 22 such that the person's legs are on the bench and the person's torso is on the pivotal board.
Figure 42:
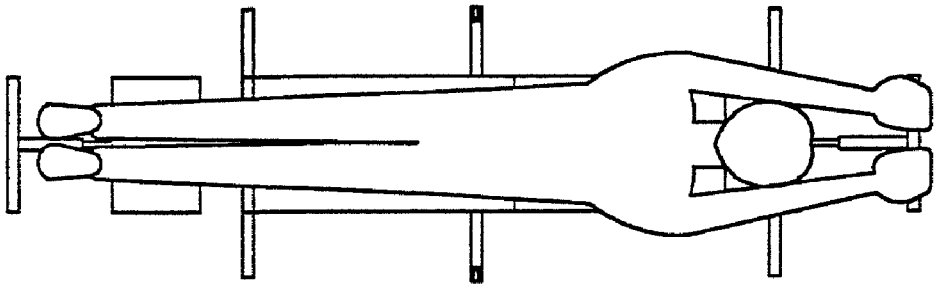
FIG. 42 is top plan view of FIG. 41.
Figure 43:
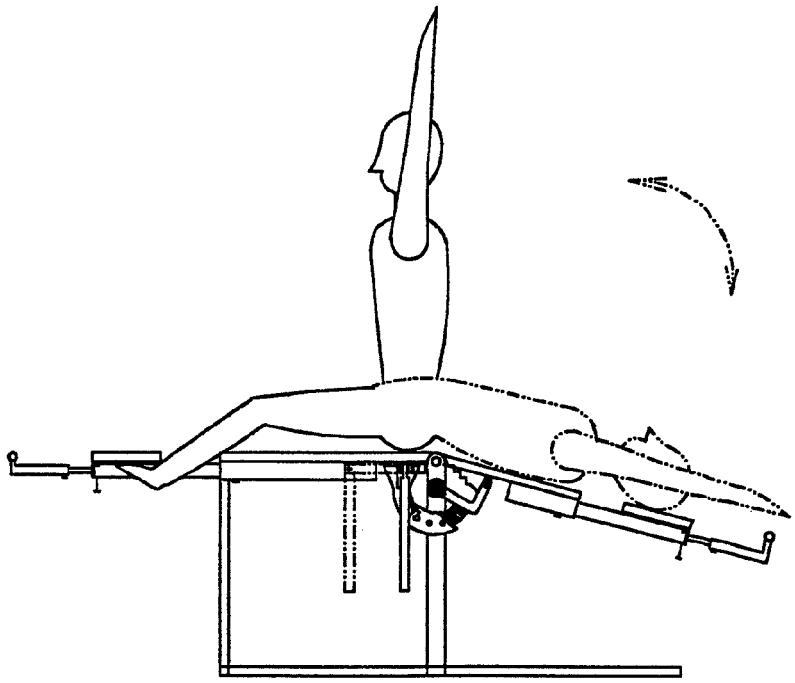
FIG. 43 is a side elevational view showing a person lying on his or her back on the bench and board section of the exercise machine of FIG. 22, such that the person's legs are on the bench and the person's torso is on the board which is at its lowermost fixed position, and the person's feet are positioned under the bench extension.
Figure 44:
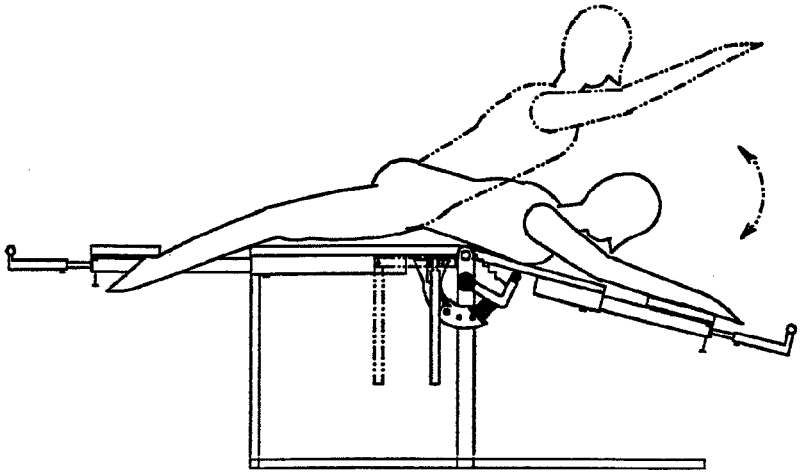
FIG. 44 is a side elevational view showing a person lying on his or her stomach on the bench and board section of the exercise machine of FIG. 22, such that the person's legs are on the bench and the person's torso is on the board which is at its lowermost fixed position, and the person's feet are positioned under the bench extension.
Figure 45:
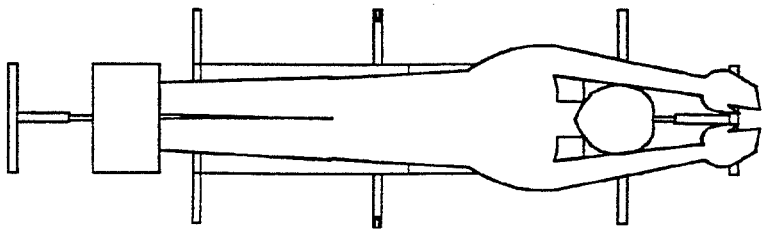
FIG. 45 is top plan view of FIG. 44.
Figure 46:
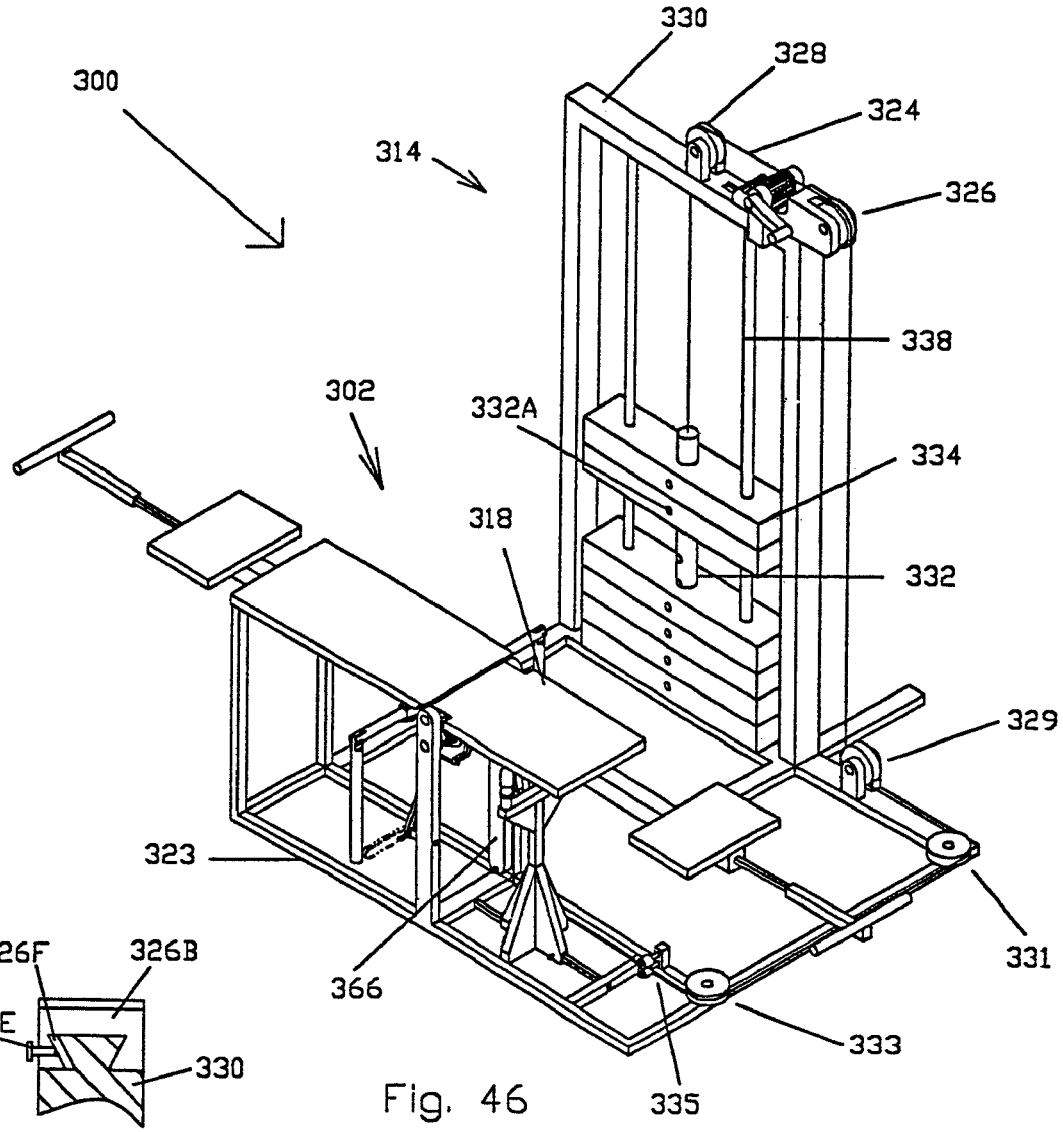
FIG. 46 is a perspective view of an exercise machine according to a third embodiment of the invention.
Figure 50:
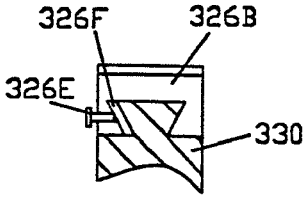
FIG. 50 is a cross-sectional view of the sliding arrangement of the cable tension adjuster on the vertically oriented frame.
Figure 49:
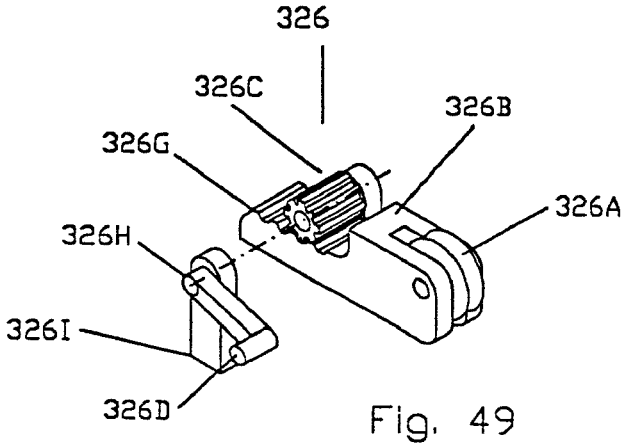
FIG. 49 is a perspective view of the cable tension adjuster.
Figure 48:
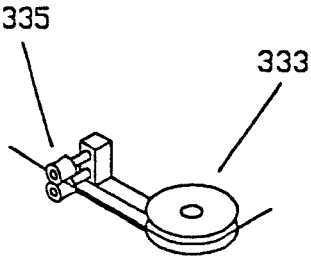
FIG. 48 is a perspective view of the rollers and adjacent pulley of the pulley system of the exercise machine of FIG. 46.

Side holders 156 are pivotally mounted to the underside of bench 116 by pivot pins 158, for movement to a position parallel to and underneath bench 116 while not in use and in a closed position, as shown in dot-dash lines in FIGS. 25, 26 and 28, and extending out perpendicular to bench 116 while in use, as shown in FIGS. 22 and 27 and the solid lines in FIGS. 25, 26 and 28. Side holders 156 can be held onto while performing exercises, thereby preventing the body from slipping.

Sit up holders 160 are provided at the ends of side holders 156 for helping a person to sit up after the person performs an exercise while lying down. Sit up holders 160 can swing up when a person holds onto them while performing sit ups, as shown by solid lines in FIG. 27, and can swing down when not in use, as shown in FIGS. 22, 25 and 28 and by the dashed lines in FIG. 27.

Exercise machine 110 further includes a raising device 162 beneath bench and board section 112 for raising board 118, using stacked weights, with the stacked weights being omitted from FIG. 28 for the sake of clarity.

Raising device 162 includes a weight holder 164 comprised of an arm 166, the upper end of which is fixed on an axle 168 mounted between two legs 122. A hollow stub tube 170 extends perpendicularly from the lower end of arm 166 so as to be horizontally oriented, and is positioned beneath bench 116. A horizontally oriented bar 172 is rotatably mounted in stub tube 170, and a normally vertically oriented hollow post 174 is fixed to bar 172 for stacking weights 176 thereon. Because bar 172 can rotate within stub tube 170, post 174 can rotate between the vertical position shown by solid lines in FIGS. 25-28 and the horizontal dot-dash line position shown in FIGS. 25 and 26.

As shown in FIGS. 29-31, in order to releasably lock post 174 in the vertical position, a latch pin 178 is slidably positioned in an opening 180 at the lower end of a wall of post 174. Latch pin 178 has a first end which extends into an opening in an external projection 182 of stub tube 170 for releasably locking post 174 in the vertical position, and a second, opposite end that extends into hollow post 174. Latch pin 178 includes a disk 184 centrally thereon, and a coil spring 186 in opening 180 has one end abutting against a partial closure 188 of opening 180 and disk 184 to normally bias latch pin 178 out of the opening in external projection 182.

A rod 190 is slidably positioned in post 174 and includes an opening 192 having a lower inclined surface 194. When rod 190 is in a raised position, as shown in FIG. 30, inclined surface 194 abuts against the second, opposite end of latch pin 178 to push the opposite first end of latch pin 178 into the opening in external projection 182 of stub tube 170. A button 196 is provided on the top of rod 190 and extends slightly out from the upper end of post 174. A cap 198 at the upper end of post 174 engages with an enlarged disk 199 at the upper end of rod 190 to prevent rod 190 from escaping from post 174. A larger diameter opening 200 is provided at the inner surface of the open end of post 174, thereby forming an annular shoulder 202 at the lower end of larger diameter opening 200. Further, A spring 204 is positioned in larger diameter opening 200 and engages between annular shoulder 202 and enlarged disk 199 to push rod 190 in a direction out of post 174, so that lower inclined surface 194 normally abut against the second, opposite end of latch pin 178 to push the opposite first end of latch pin 178 into the opening in external projection 182 of stub tube 170. However, when button 196 is pushed down against the force of spring 204, lower inclined surface 194 is moved down, whereby spring 186 pushes latch pin 178 to the right in FIG. 30 and out of the opening in external projection 182 of stub tube 170. In such case, post 174 and bar 172 can rotate within stub tube 170 to the horizontal position shown by dot-dash lines in FIGS. 25 and 26 so that weights 176 can be added thereto, whereupon, post 174 is rotated back to the vertical position and locked in place by latch pin 178.

Alternatively, rather than releasing pin 178 by spring 186 when inclined surface 194 is moved down, an arrangement can be provided whereby inclined surface 194, when pushed down, directly engages the head of pin 178 to pull pin 178 out.

There is another latch 206 between bar 172 and arm 166 for releasably retaining bar 172 and post 174 in either the vertical position shown by solid lines in FIGS. 25-29 for exercising or the horizontal dot-dash line position shown in FIGS. 25 and 26 for loading weights onto post 174. Preferably, latch 206 comprises a square-head and set-screw, which engages with a set-screw nut 208 which matches latch 206. In such case, there is a square hole in the end of bar 172 that rotates and moves latch 206 into and out of engagement to lock bar 172 in one of the two rotatable positions. Thus, bar 172 can be pulled out, rotated and pushed back in to a different rotatable position and locked therein. Of course, any other suitable arrangement can be used for releasably locking bar 172 in one of the two rotatable positions. For example, the latch can rotate out to fit into a hole in a leg 122, to keep the entire weight holder 164 from moving while weights are being added or removed.

When post 174 is rotated down to the horizontal position, it is in line with a spare weight holder 210 for holding additional weights 176 for use in the exercise and which can be loaded onto post 174. Spare weight holder 210 comprises a bar 212 mounted to a vertical extension at the rear of frame 123 and extending in line with the lengthwise direction of bench 116, for mounting weights 176 thereon. A bar 214 is pivotally mounted to the end of bar 212. When adding or removing weights 176, bar 214 is in line with bar 212, as shown in FIGS. 25 and 26 by the dot-dash lines therein. In such case, weights 176 can move onto or off from bars 212 and 214. However, when exercise machine 110 is in use, weights 176 are not permitted to be added or removed, and in this regard bar 214 is pivoted to a position perpendicular to bar 212, as shown in FIG. 22. A clip 216 can be provided on bar 212 for preventing movement of weights 176 thereon. In like manner, a clip 218 can be provided in association with post 174 to prevent weights 176 from moving thereon, as shown in FIG. 22.

In order to transmit the energy from board 118 during an exercise to weight holder 164, raising device 162 includes a small L-shaped lever 222 rotatably mounted on axle 168. A small wheel 222A is provided on the free end of lever 222, with wheel 222A in contact with the bottom of board 118. While exercise machine 110 is in use, board 118 is moving up and down, and wheel 222A moves along the bottom of board 118. A small spring 222B is connected between the free end of lever 222 and the pivoted end of board 118 so as to force small wheel 222A in the counter-clockwise direction of FIG. 28, always in contact with board 118. As will be explained hereinafter, lever 222 can be releasably fixed with axle 168.

In this manner, when lever 222 is fixed relative to axle 168, and as board 118 is pushed down from the initial position of FIG. 25, axle 168 is caused to rotate by lever 222. As a result, arm 166 and post 174 also rotate in the clockwise direction of FIG. 25 to an angle relative to the vertical. When the pushing force is removed or lessened, the force created by the weights 176 on the rotated post 174, causes board 118 to move back to its original position, whereby post 174 again is vertically oriented.

However, to prevent arm 166 from traveling too far during the return movement, an over-rotation stopper 260 is mounted on a leg 122, as shown in FIGS. 25 and 28, against which arm 166 impacts to prevent weight holder 164 from over-rotating. Preferably, over-rotation stopper 260 includes a set of plate springs for helping weight holder 164 stop slowly.

In accordance with the present invention, the initial angle of board 118 can be adjusted from that shown in FIG. 25, with post 174 maintained in the vertical orientation, in order to vary the exercises and/or adjust for the individual.

Accordingly, a board swing up angle adjuster 224 includes a spline 226 fixed on lever 222, a spline 228 fixed on axle 168 immediately adjacent to spline 226, and an outer spline 230 mounted over splines 226 and 228 and in meshing engagement therewith, in order to lock lever 222 to axle 168. When outer spline 230 moves away from lever 222 so as only to cover spline 228 on axle 168, lever 222 is free to rotate around axle 168. This allows a person to select different initial angular orientations for board 118. When outer spline 230 covers both splines 226 and 228 on axle 168 and lever 222, exercise machine 110 is ready to work. In such case, energy transfers from board 118 to lever 222, then from spline 226 on lever 222 to outer spline 230, then to spline 228 on axle 168, then to arm 166, and finally to weight holder 164.

As shown in FIGS. 27 and 28, in order to move outer spline 230, a spline mover 232 is provided and includes diametrically opposite cylindrical projections 234 extending radially out from the outer surface of outer spline 230. Each cylindrical projection 234 includes a fixed post and a cylindrical member rotatable around the fixed post. An arm 236 is connected to a lower end of a frame 238 that is in contact with projections 234. Arm 236 is pivoted at its lower end to the frame by a pivot pin 236A. The lower end of arm 236 further includes a pivotal foot pedal 236B which can pivot down and out from a stored position. Thus, as a person pushes against the foot pedal 236B, pivoting frame 238 functions to move outer spline 230 away from lever 222, thereby disengaging outer spline 230 from spline 226. Foot pedal 236B is normally parallel to arm 236 for safety purposes and to save space. After spline 230 has been moved out of engagement with spline 226, board 118 is adjusted to the desired angular orientation by grasping and pivoting board 118, and thereby lever 222 moves with board 118. Accordingly, spline 226, which is fixed to lever 222, moves with lever 222, to adjust the position of spline 226 relative to spline 228. Thereafter, when foot pedal 236B is disengaged, a spring 240 biases outer spline 230 back over both splines 226 and 228, thereby resulting in board 118 being provided at a different angular orientation. At such time, a small spring 242 engaged between frame 238 and the machine frame, functions to move frame 238 back to its original neutral position. In this manner, different angles for board 118 can be selected as an initial position.

The downward extent that board 118 pivots down during an exercise is also limited. Specifically, as shown in FIGS. 28 and 33-35, a board swing down angle adjuster 244 is comprised of a first element 246 mounted to the underside of bench 116 and a second element 248 telescopically received over first element 246. Each of elements 246 and 248 have a plurality of holes that can be aligned with each other, and a pin 250 can be inserted therein to select the position of second element 248 on first element 246 and to thereby fix first and second elements relative to each other. As will be appreciated from the discussion hereinafter, by selecting different holes for pin 250, the lower limit of pivoting movement of board 118 can be changed.

A stop spring 252 is provided on the free end of second element 248 for helping board 118 stop slowly. Specifically, stop spring 252 preferably comprises many pieces of plate spring 254 arranged in a bellows like arrangement, and two nails or bolts 256 secure the ends of plate spring 254 to the free end of second element 248. Thus, as board 118 is pushed down, it pushes down lever 222 with it, and lever 222 abuts against stop spring 252 at the lower limit.

As with the first embodiment, there is a resistance means associated with the pivoting board.

Third Embodiment

Referring to FIGS. 46-53, an exercise machine 300 according to a third embodiment of the present invention will now be discussed. Exercise machine 300 includes a bench and board section 302 which is identical to bench and board section 112 of the second embodiment, except for the resistance means, and therefore, a detailed discussion thereof will be omitted for the sake of brevity. Exercise machine 300 is basically a hybrid of the first and second embodiments.

Figures 47, 53:
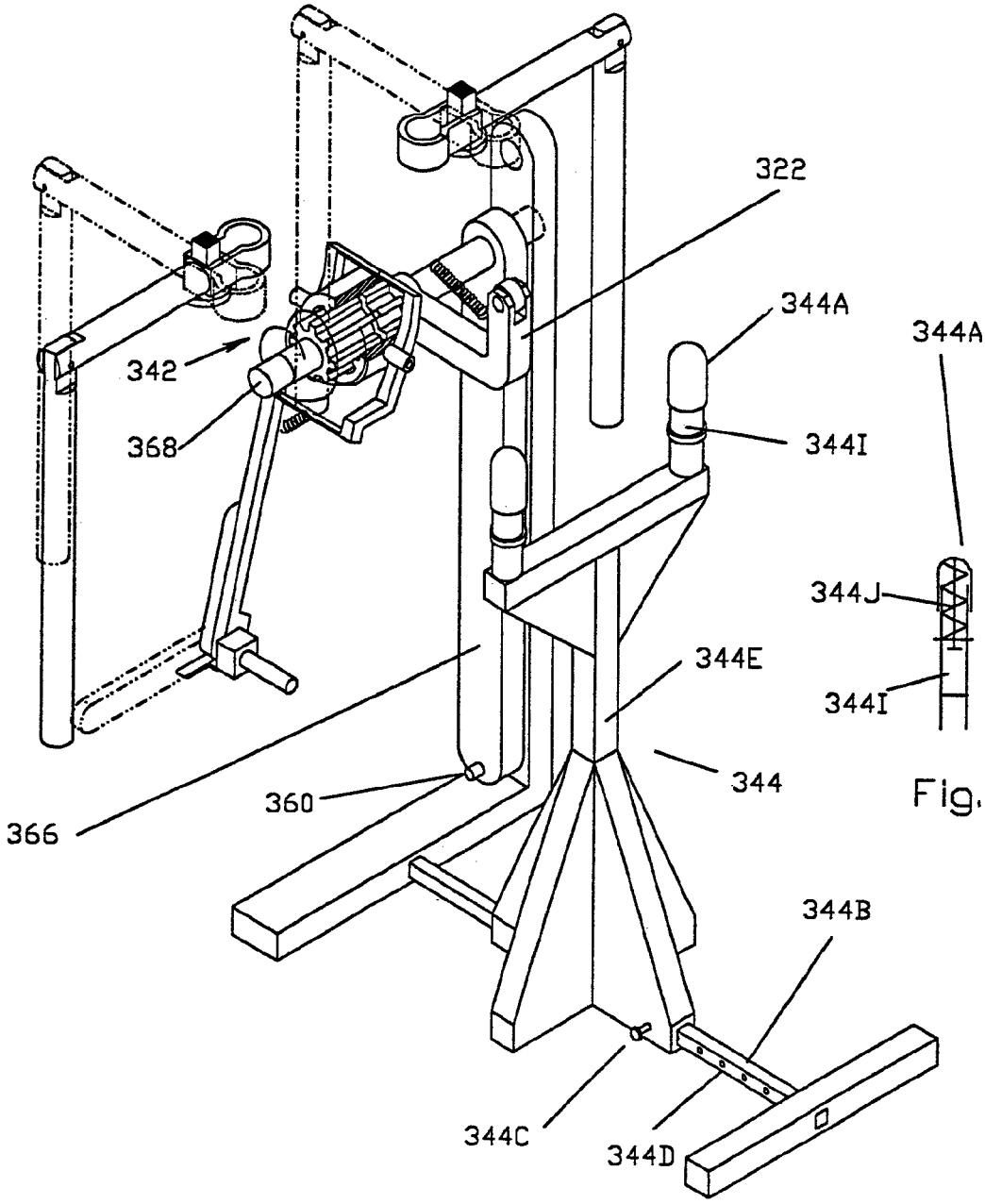
FIG. 47 is a perspective view of the board swing up angle adjuster and board swing down angle adjuster of the exercise machine of FIG. 46.
FIG. 53 is a schematic cross-sectional view of the stop spring arrangement of the board swing down angle adjuster of the exercise machine of FIG. 46.

As with the second embodiment, exercise machine 300 includes a board swing up angle adjuster 342, as shown in FIG. 47, which is identical to board swing up angle adjuster 224 of the second embodiment, and therefore a detailed description thereof will be omitted. Thus, for example, board swing up angle adjuster 342 includes an axle 368, a lever 322 rotatably mounted on axle 368 and which can be fixed thereto by the adjustable spline assembly, and an arm 366 fixed to axle 368. However, rather than weight plates being indirectly mounted to arm 366, the resistance means includes a pulley system 314 similar to that of the first embodiment, for controlling raising and lowering of the opposite end of the pivotal board of bench and board section 302. In this regard, the lower end of arm 366 includes a projection 360 connected to one end of a cable 324 of pulley system 314.

Cable 324 travels from projection 360 to a nip between two rollers 335 mounted to lower frame 323 and around a pulley 333 also mounted to lower frame 323, where it makes a 90° bend. Rollers 335 are provided for controlling cable 324 from shaking, and preventing cable 324 from slipping out of pulley 333. From there, cable 324 travels around another pulley 331 mounted to lower frame 323, where it makes a further 90° bend, still lying in the horizontal plane. Cable 324 then travels around a pulley 329 mounted to lower frame 323 where it travels vertically upward around a pulley 326A mounted to a cable tension adjuster 326 which is mounted to the upper end of a rectangular vertically oriented frame 330. As will be appreciated, vertically oriented frame 330 is identical to vertically oriented frame 30 of the first embodiment, and thereby includes a vertical bar 332 having a plurality of holes and on which a plurality of stacked weight plates 334 are positioned, each stacked weight plate 334 having a hole. In this manner, a pin 332A, as is conventional, can be inserted through a hole in a stacked weight plate 334 to connect the respective weight plate 334 to vertical bar 332. Accordingly, as will be appreciated from the discussion hereinafter, when cable 324 pulls vertical bar 332 upwardly, the connected weight plate 334, and all weight plates 334 situated thereabove, are raised. In this regard, each weight plate 334 is slidably positioned on two vertical bars 338.

From pulley 326A of cable tension adjuster 326, cable 324 is turned 90° and travels around a pulley 328 mounted centrally to the upper end of vertically oriented frame 330 and then down through an opening (not shown) in frame 330 and is connected to vertical bar 332. In this regard, as board 318 is pushed down, the resistance is provided through cable 324 connected to the weight stack mounted to vertical bar 332.

Cable tension adjuster 326 is provided for adjusting loose cable, and is comprised of a gear rack 326B slidably connected by a dovetail arrangement to the upper surface of vertically oriented frame 330. Gear rack 326B can be releasably fixed at a selected position by a bolt 326E extending through a side wall of guide rack 326B and engaging a plate 326F interposed between gear rack 326B and vertically oriented frame 330 in the dovetail sliding arrangement. Plate 326F thereby tightens gear rack 326B to vertically oriented frame 330 without damaging frame 330.

Gear rack 326B has a rack 326G on the upper surface with a plurality of teeth. A gear 326C is positioned on rack 326G in meshing engagement with the teeth thereof. Gear 326C is fixed on an axle 326H which extends outwardly through ears 326I extending upwardly from vertically oriented frame 330, and a rotatable handle 326D is connected to axle 326H. Thus, as handle 326D is rotated, gear rack 326B is caused to move in a direction along the upper surface of vertically oriented frame 330 to tighten or loosen cable 324.

Further, a board swing down adjuster 344 is provided on the ground, as shown in FIGS. 47 and 53, and comprises a sliding track 344B connected with lower frame 323 for moving board swing down adjuster 344 toward or away from lower frame 323. Sliding track 344B includes a plurality of holes 344D therein, and a vertical mount 344E is slidably mounted on track 344B and includes a hole that can align with holes 344D. A pin 344C is inserted through the hole in vertical mount 344E and one of the selected holes 344D to adjust the position of vertical mount 344E on sliding track 344B.

The upper end of vertical mount 344E includes two spaced apart posts 344I, each having a spring 344J therein and a cap 344A positioned thereover. Thus, as board 118 is pushed down, the underside thereof impacts against caps 344A which are pushed down against the force of springs 344J, for helping board 118 stop slowly.

Figure 51:
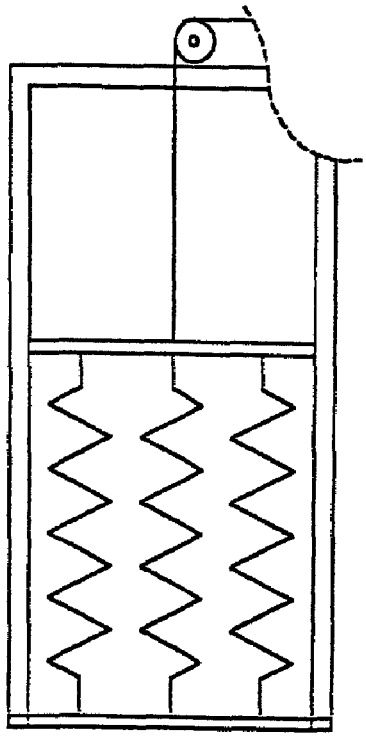
FIG. 51 is an elevational view of a modification of the third embodiment in which a different resistance means is used.
Figure 52:
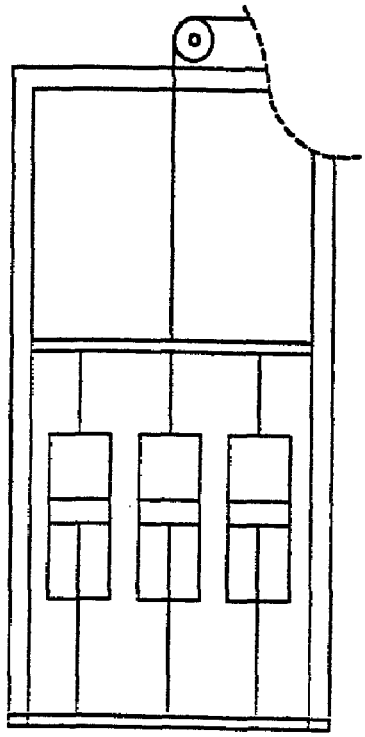
FIG. 52 is an elevational view of a modification of the third embodiment in which a still different resistance means is used.

As in the first embodiment, the stacked weight plates 334 can be replaced with other resistance means, such as tension springs, as shown in FIG. 51, compression piston-cylinders, as shown in FIG. 52, elastomer materials or the like.

Fourth Embodiment

Figure 54:
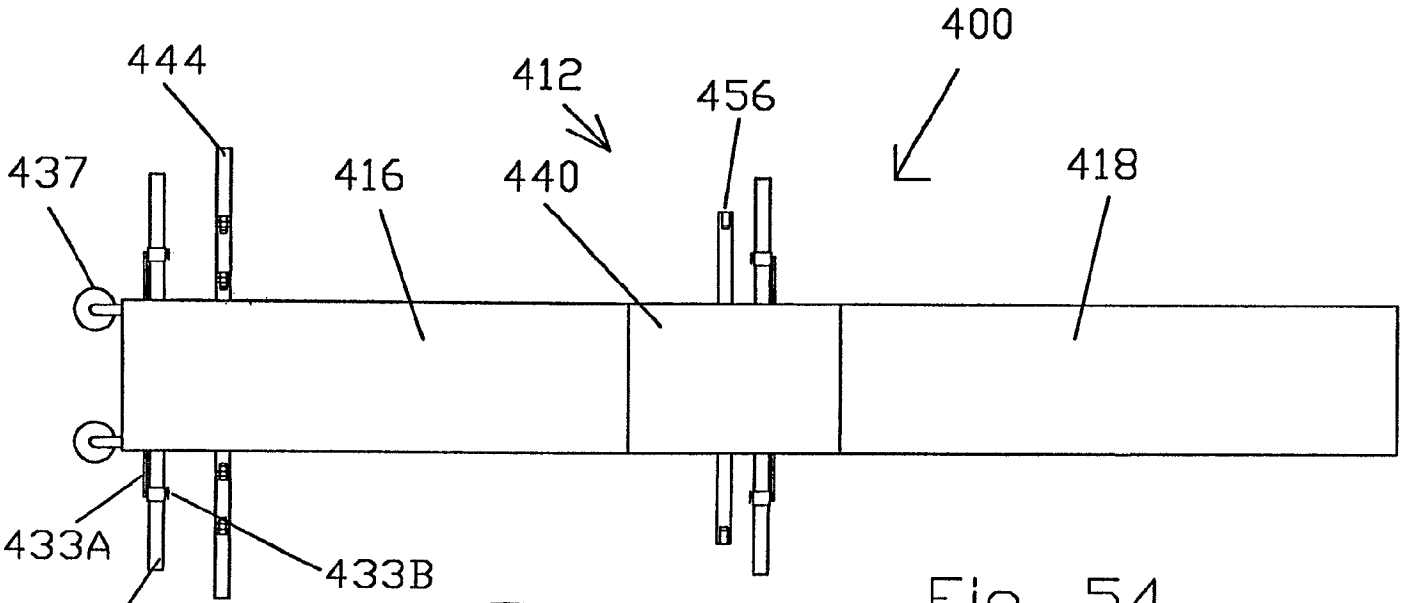
FIG. 54 is a top plan view of an exercise machine according to a fourth embodiment of the invention.
Figure 61:
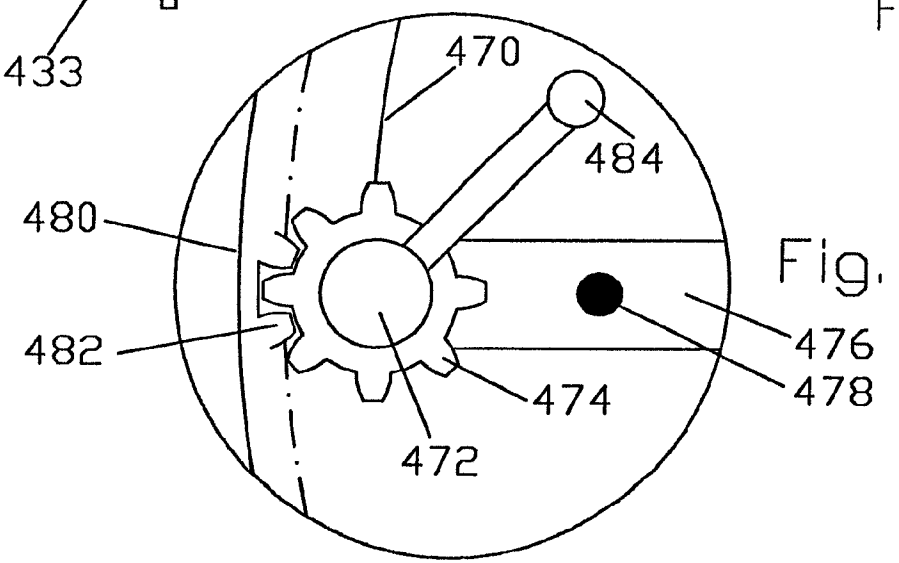
FIG. 61 is an enlarged elevational view, illustrating the connection of the spiral spring, small gear and internal gear, which form a resistance adjuster.
Figure 55:
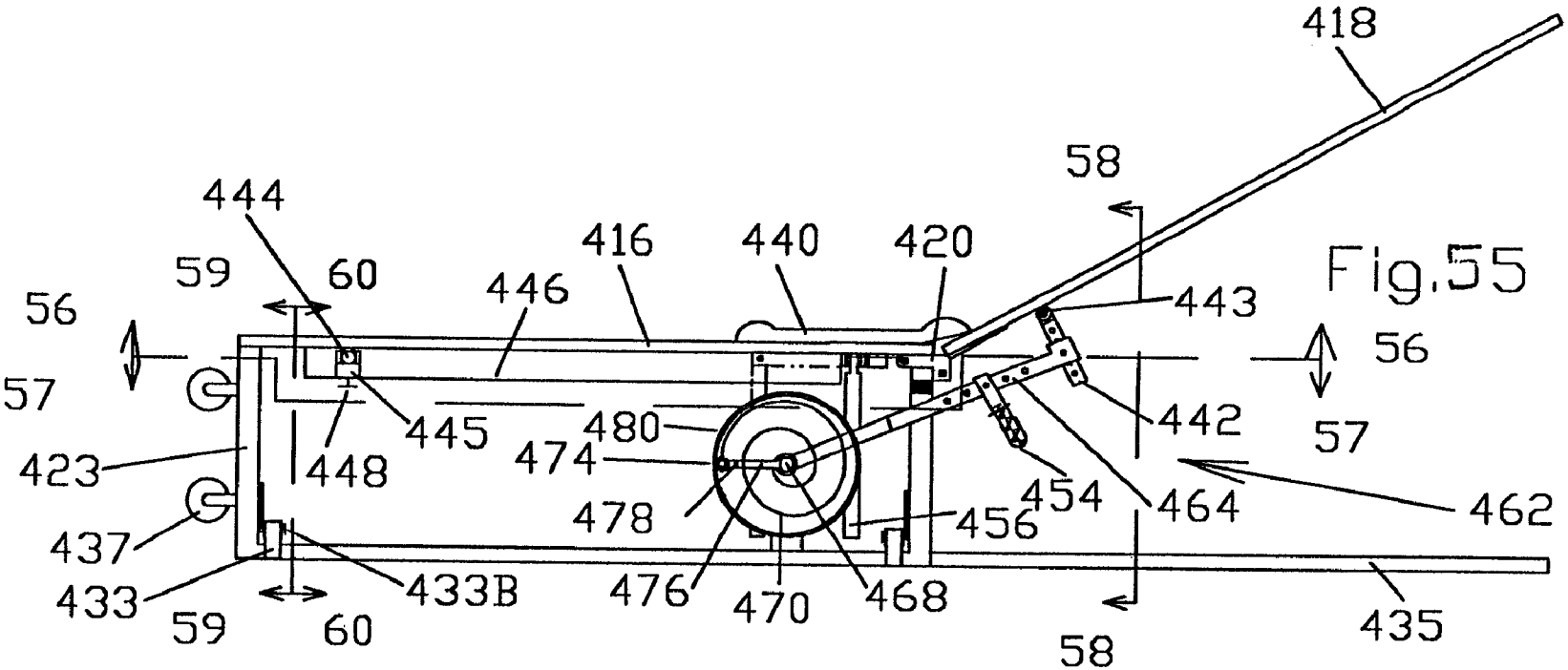
FIG. 55 is an elevational view of the exercise machine of FIG. 54.
Figure 56:
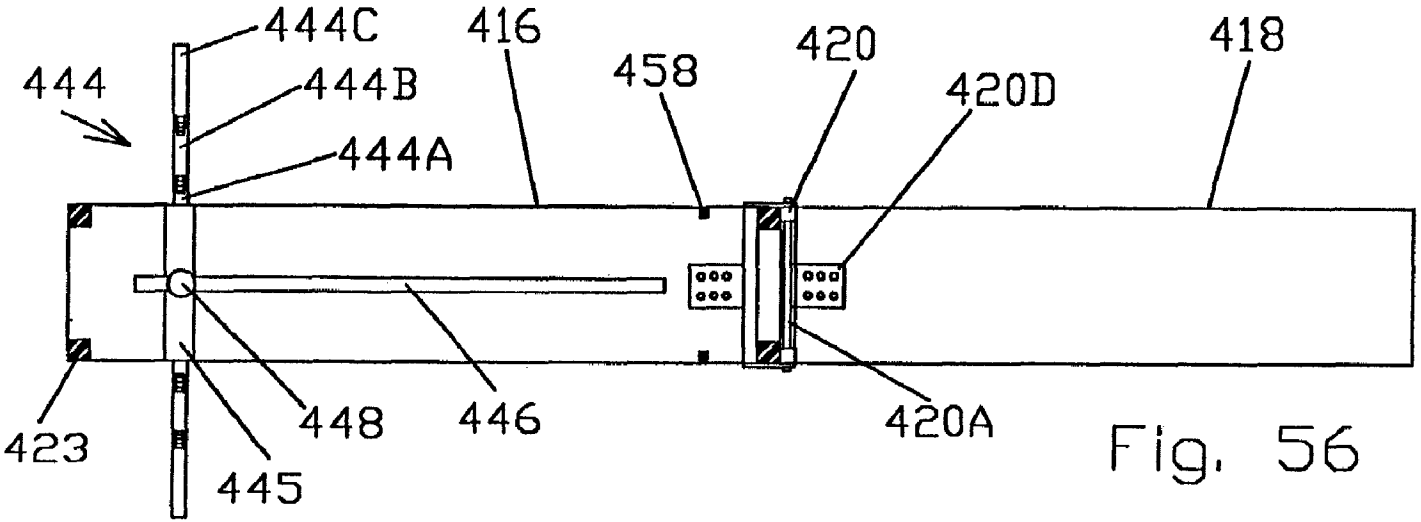
FIG. 56 is a cross-sectional view of the exercise machine of FIG. 55, taken along line 56-56 thereof.
Figure 62:
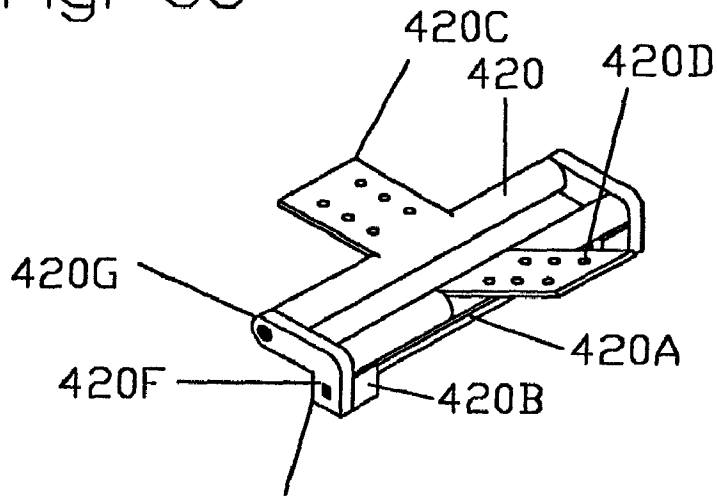
FIG. 62 is an enlarged perspective view of the double hinge.
Figure 65:
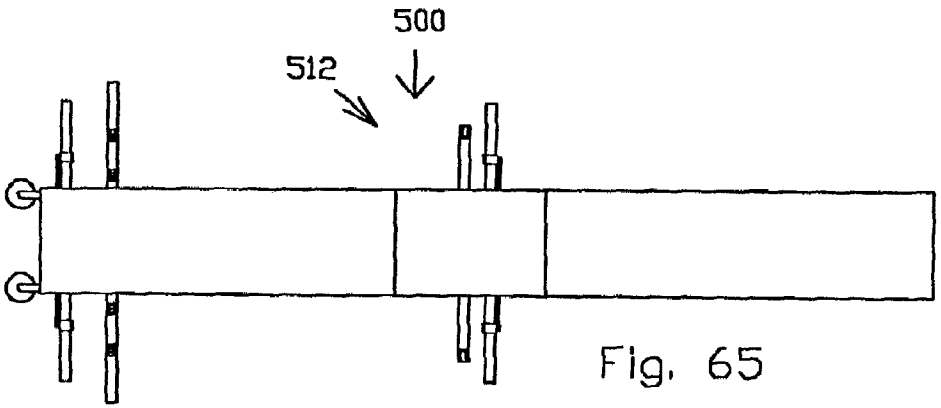
FIG. 65 is a top plan view of an exercise machine according to a fifth embodiment of the present invention.

Referring to FIGS. 54-64, an exercise machine 400 according to a fourth embodiment of the invention includes a bench and board section 412 comprised of a stationary bench 416 and a board 418 pivotally hinged at one end to an end of bench 416 by hinges 420 shown best in FIGS. 56 and 62. As shown, one side 420C of double hinges 420 is mounted to the underside at one end of bench 416, and the opposite side 420D is mounted to the underside at the one end of board 418. Hinge 420 includes two downwardly extending ears 420E near board side 420D, each ear 420E being aligned to the outside of a ring 420B extending down from bench 416. Ears 420E and rings 420B have aligned holes 420F through which a metal rod 420A extends for further stabilizing hinge 420 in order to maintain hinge 420 tight against the legs of bench 416 during an exercise. Hinge 420 permits board 418 to be pivoted to a position above the horizontal with respect to bench 416 and below the horizontal with respect to bench 416, as will be understood better from the description hereinafter.

Figure 63:
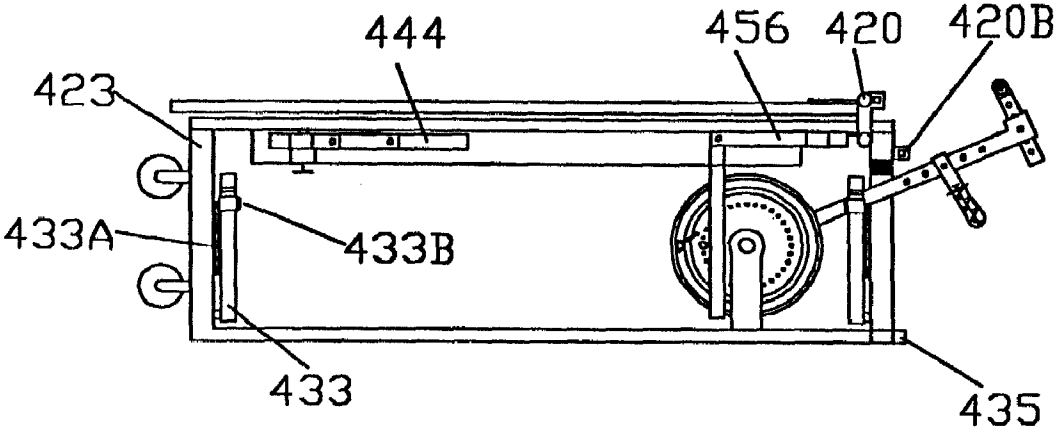
FIG. 63 is an elevational view showing the exercise machine in a closed condition.

In addition, when metal rod 420A is removed, hinge 420 can pivot about a hinge pin 420G (FIG. 62) at the bench side, as shown in FIG. 63, for positioning board 418 on top of stationary bench 416 for storage. Bench 416 is supported on legs 422, as is conventional, at the front and rear of bench 16.

In order to provide comfort to a person utilizing exercise machine 400, a pad 440 constructed in the same manner as pad 40 of the first embodiment is mounted on exercise machine 400 between bench 416 and board 418 in the same manner as in the first embodiment.

Figure 57:
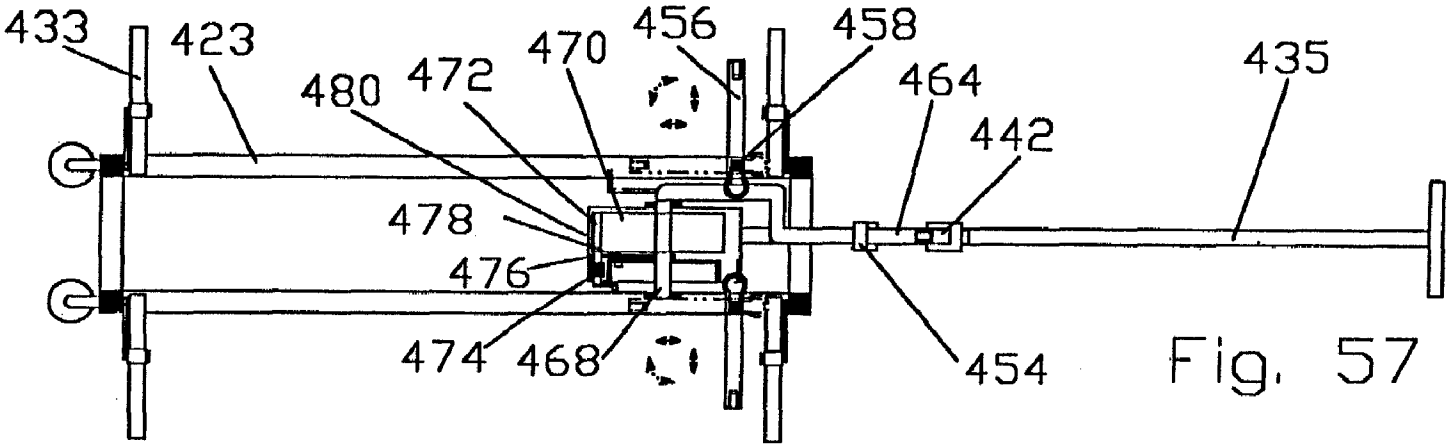
FIG. 57 is a cross-sectional view of the exercise machine of FIG. 55, taken along line 57-57 thereof.
Figure 58:
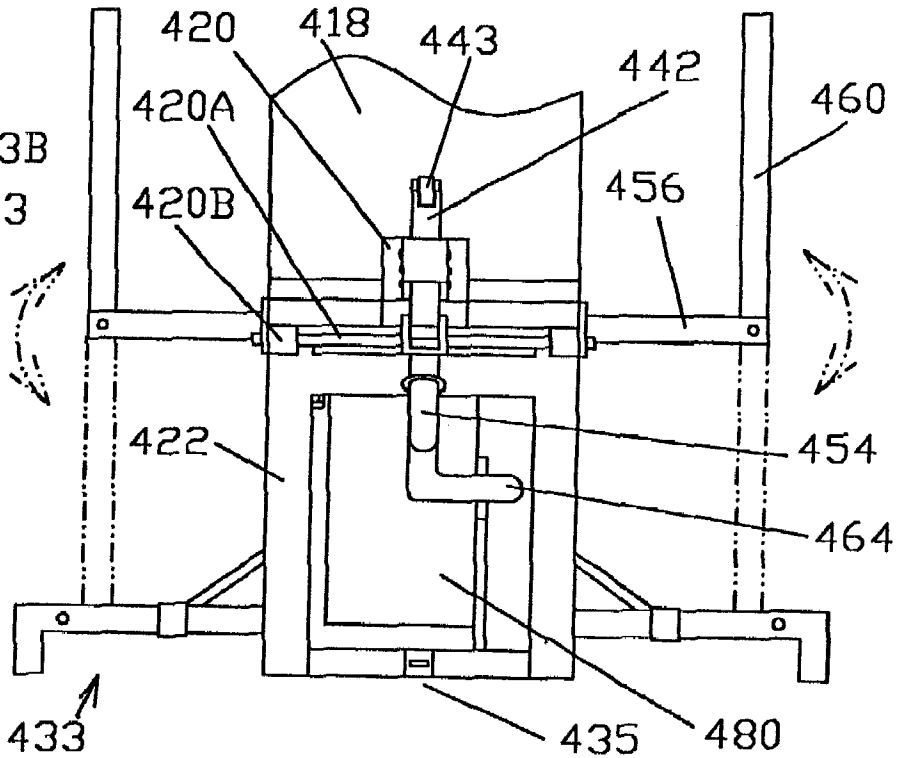
FIG. 58 is an enlarged cross-sectional view of the exercise machine of FIG. 55, taken along line 58-58 thereof.

Side holders 456 are pivotally mounted to the underside of bench 416 by pivot pins 458, for movement to a position parallel to and underneath bench 416 while not in use and in a closed position, as shown in FIG. 63, and extending out perpendicular to bench 416 while in use, as shown in FIGS. 54, 57 and 58. Side holders 456 can be held onto while performing exercises, thereby preventing the body from slipping.

Sit up holders 460 are provided at the ends of side holders 456 for helping a person to sit up after the person performs an exercise while lying down. Sit up holders 460 can swing up when a person holds onto them while performing sit ups, as shown by solid lines in FIG. 58, and can swing down when not in use, as shown in FIG. 58 by dashed lines.

Figure 60:
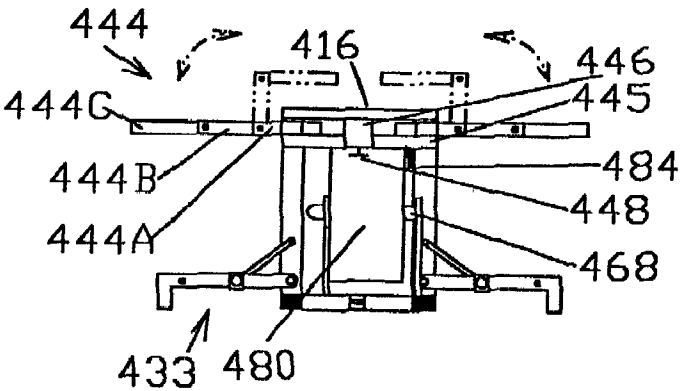
FIG. 60 is a cross-sectional view of the exercise machine of FIG. 55, taken along line 60-60 thereof.

As best shown in FIG. 56, horizontally oriented bars 444, each comprised of three sections 444A, 444B and 444C pivotally connected to each other, extend out from both sides of the opposite end of bench 416. Each section 444A is pivotally connected to a stand 445 which can slide in a sliding track 446 provided at the underside of bench 416 and which extends in the lengthwise direction of bench 416. Stand 445 can be releasably fixed at a desired position in sliding track 446 by a tightening bolt 448. Alternatively, a pin can be used in place of bolt 448 and inserted in different openings in sliding track 446 to position stand 445 at different positions of sliding track 446. In this manner, bars 444 can be moved to a desired lengthwise position along bench 416, and sections 444A, 444B and 444C can then be pivoted relative to each other to provide different configurations for holding onto, for example, as shown in FIGS. 54, 56 and 60, while performing exercises. For example, FIG. 60 shows the bars 444 bent over bench 416, allowing the elbows of the person to be placed on bench 416 while holding onto bars 444, increasing the person's comfort. Bars 444 can be positioned parallel to and under bench 416 while not in use, as shown in FIG. 63. Further, covers (not shown) can be placed on bars 444 to cover sections 444A, 444B and 444C.

Exercise machine 400 further includes a raising device 462 beneath bench and board section 412 for raising board 418, using a spiral spring.

Raising device 462 comprises a lever 464 having one end connected to an axle 468. The inner end of a spiral spring 470 also connects to axle 468. One end of lever 464 has a board swing up angle adjuster 442 thereon which contacts the underside of raising board 418. Axle 468 transfers the energy from board 418 to spiral spring 470, as shown in FIGS. 55 and 57, so that swing up angle adjuster 442 is biased in the direction of board 418. There is a small wheel 443 on the end of board swing up angle adjuster 442 which contacts the underside of board 418 while the machine is in use. When board 418 swings up and down, wheel 443 moves along the bottom of board 418.

As discussed above, the other end of lever 464 is connected to axle 468, and axle 468 is connected to spiral spring 470, with axle 468 being in the center of spiral spring 470. A small axle 472 is connected to the opposite end of spiral spring 470, with a small gear 474 mounted on small axle 472, as shown in FIG. 61. An arm 476 is connected between axle 468 and small axle 472, and a pin 478 holds arm 476 on an outer casing or box 480 in which spiral spring 470 is encased. When pin 478 is not inserted, small gear 474 can move on internal gear 482 provided on the inner surface of casing 480, and when pin 478 is inserted, small gear 474 cannot move, that is, is fixed in position. Small gear 474, when movable, can move along internal gear 482 in order to select different positions to adjust the resistance. A handle 484 connected with small axle 472 is used to move small gear 474 to different positions on internal gear 482, as shown in FIG. 61.

A stop spring 454 is installed on lever 464 in order to help board 418 stop slowly. By selecting different holes on lever 464 to which stop spring 454 is attached, lever 464 will make different angles for board 418 to swing down, thereby forming a board swing down angle adjuster.

Figure 59:
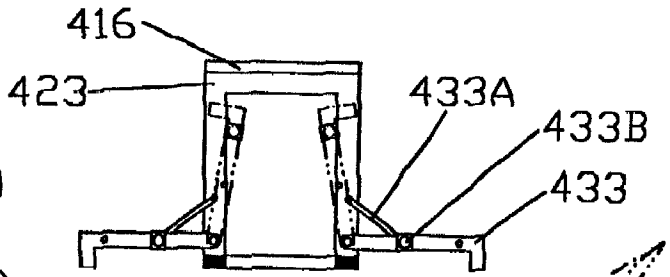
FIG. 59 is a cross-sectional view of the exercise machine of FIG. 55, taken along line 59-59 thereof.

The lower frame 423 includes four foldable feet 433, a sliding track 435, and four wheels 437, as shown in FIGS. 54, 55, 57-60, 63 and 64. Foldable feet 433 are installed on sides of lower frame 423. When feet 433 are folded to an open condition, they keep the bench stable. Foldable feet 433 close to save space, as shown in FIG. 59 by the dashed lines. A strut stick 433A and pin 433B are provided on foldable feet 433 for locking feet 433 in the open position, when the machine is in use. When feet 433 are folded against lower frame 423 for storage, struts 433A are parallel to feet 433, and pins 433B automatically snap into holes (not shown) near the end of feet 433 to keep feet 433 locked in a stored position.

Figure 64:
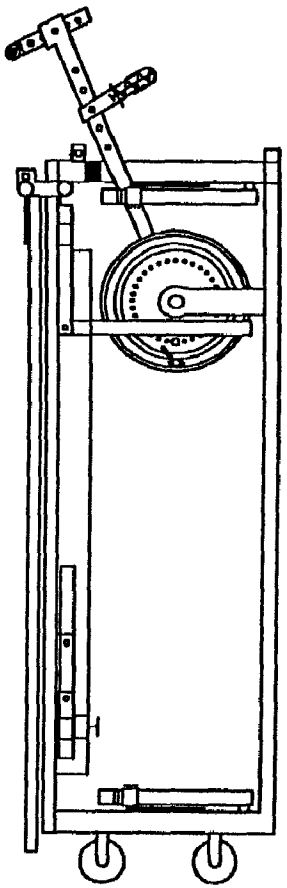
FIG. 64 is an elevational view showing the exercise machine standing up on wheels for a spacing saving purpose.

Sliding track 435 is installed on an end of lower frame 423, also keeping the bench stable. When the machine is in use, sliding track 435 is extended to its longest position, as shown in FIGS. 55 and 57. When the machine is closed, sliding track 435 is pushed in, under bench 416, as shown in FIGS. 63 and 64.

Further, when machine is closed for storage, pad 440 is preferably removed, board 418 moves over bench 416, as shown in FIG. 63. At this time, foldable feet 433 are closed, and sliding track 435 is closed under bench 416.

The machine can stand up for saving space, when storing the machine. In this regard, wheels 437 can help machine move easily, as shown in FIG. 64.

Fifth Embodiment

Referring to the drawings, and particularly to FIGS. 65-74, illustrating a fifth embodiment of the invention, an exercise machine 500 includes a bench and board section 512, as in the fourth embodiment, and a raising device 562 for raising board 518 of bench and board section 512. A description of bench and board section 512 is omitted since the construction is the same as that of bench and board section 412 of the fourth embodiment.

Raising device 562 is located under bench and board section 512, and uses a set of double-torsion springs to raise board 518. Specifically, raising device 562 includes a set of small L-shaped levers 522' and 522", each having a wheel or roller 522A at the free end thereof. Wheel 522A contacts the bottom of board 518 while the machine is in use. When board 518 swings up and down, wheel 522A moves along the bottom of board 518.

The opposite end of each of levers 522' and 522" is connected to a respective double-torsion spring 522B which functions to bias levers 522' and 522" in the direction of board 518. Although only two levers 522' and 522" are shown, the present invention is not limited thereby, and more than two levers may be used. In this case, lever 522' represents the set of levers that are in use, and lever 522" represents the set of levers that are not in use. Lever 522' thereby transfers the energy from board 518 to the respective double-torsion spring 522B, as shown in FIGS. 66, 68 and 69.

Figure 72:
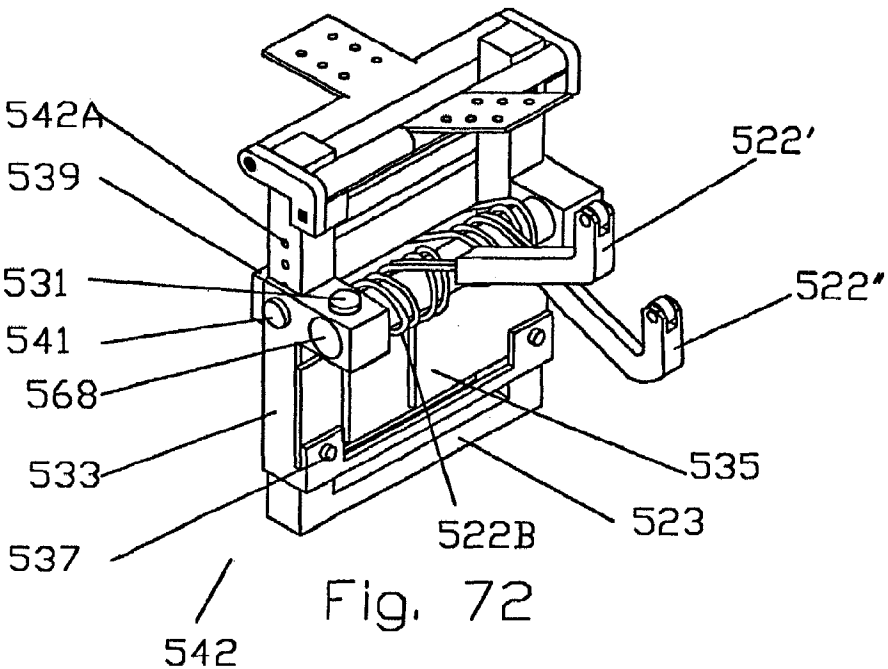
FIG. 72 is an enlarged perspective view of the double hinges, levers, double-torsion spring and spring stand.
Figure 75:
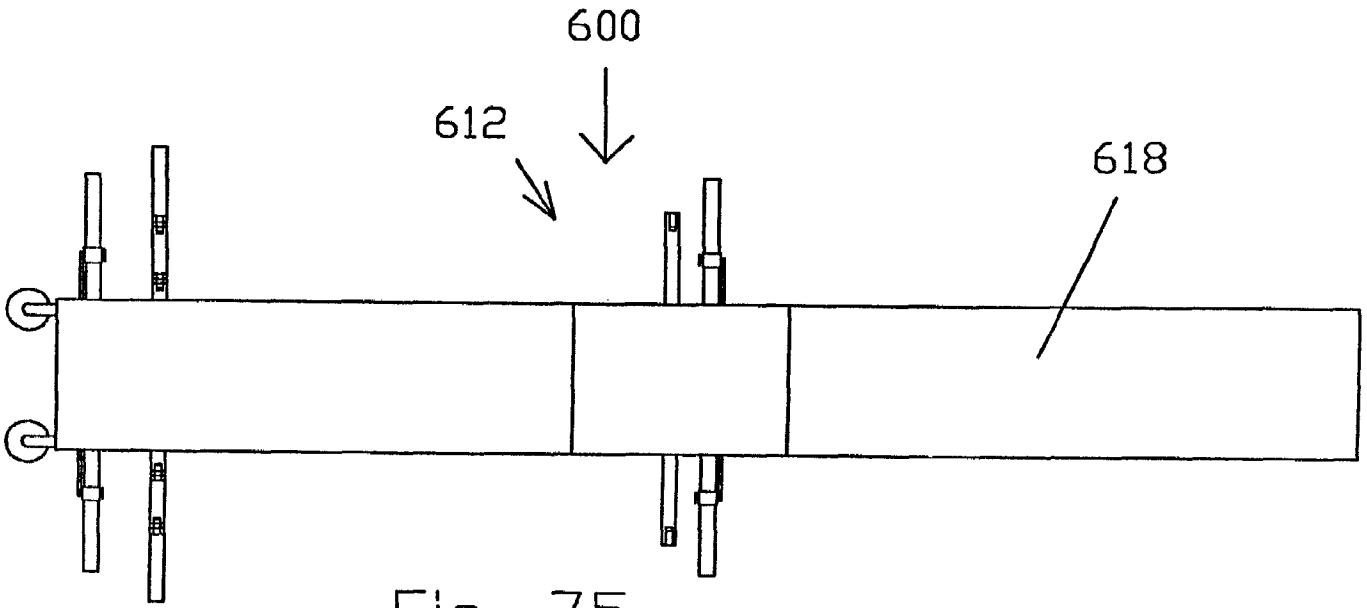
FIG. 75 is a top plan view of an exercise machine according to a sixth embodiment of the present invention.

An axle 568 is fitted through the center of double-torsion springs 522B, as shown in FIG. 72, and a pin 531 locks axle 568 on a torsion spring stand 533. By releasing pin 531, a user can easily add or remove double-torsion springs 522B and corresponding levers on axle 568. A plate 535 provides resistance for the opposite end of double-torsion spring 522B when using lever 522'. Pins 537 releasably lock plate 535 on torsion spring stand 533.

A plate 539 provides resistance for the opposite end of double-torsion spring 522B for lever 522", which is the lever not being used, that is, which constitutes a spare lever. The user can easily select which lever to be in use or not in use. If the end of double-torsion spring 522B is on the front of plate 535, the lever is in use, while if the end of double-torsion spring 522B is between plate 535 and plate 539, the lever is not in use. Pins 541 releasably lock stand 533 on frame 523. Stand 533 also forms a board swing up adjuster 542. By selecting different holes 542A on frame 523 for stand 533, different angles can be provided for board 518 to swing up.

Figure 66:
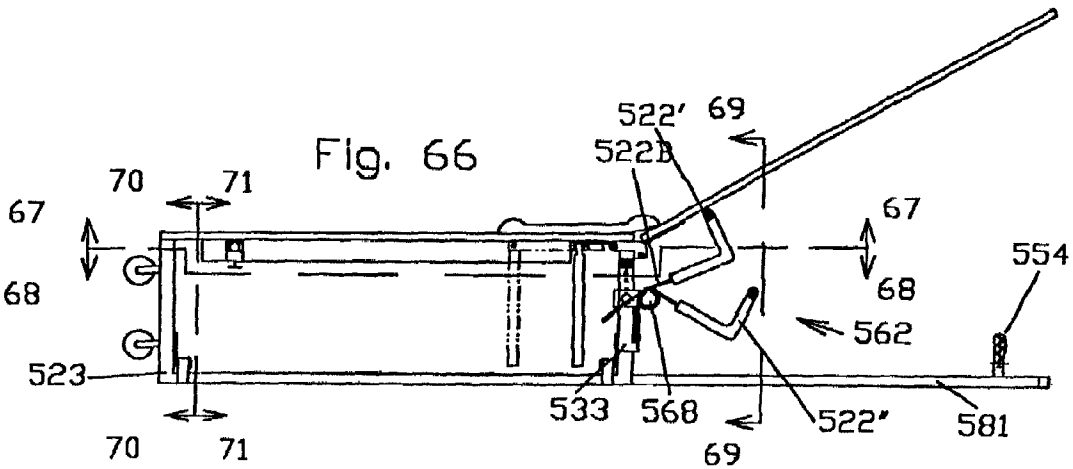
FIG. 66 is an elevational view of the exercise machine of FIG. 65.
Figure 67:
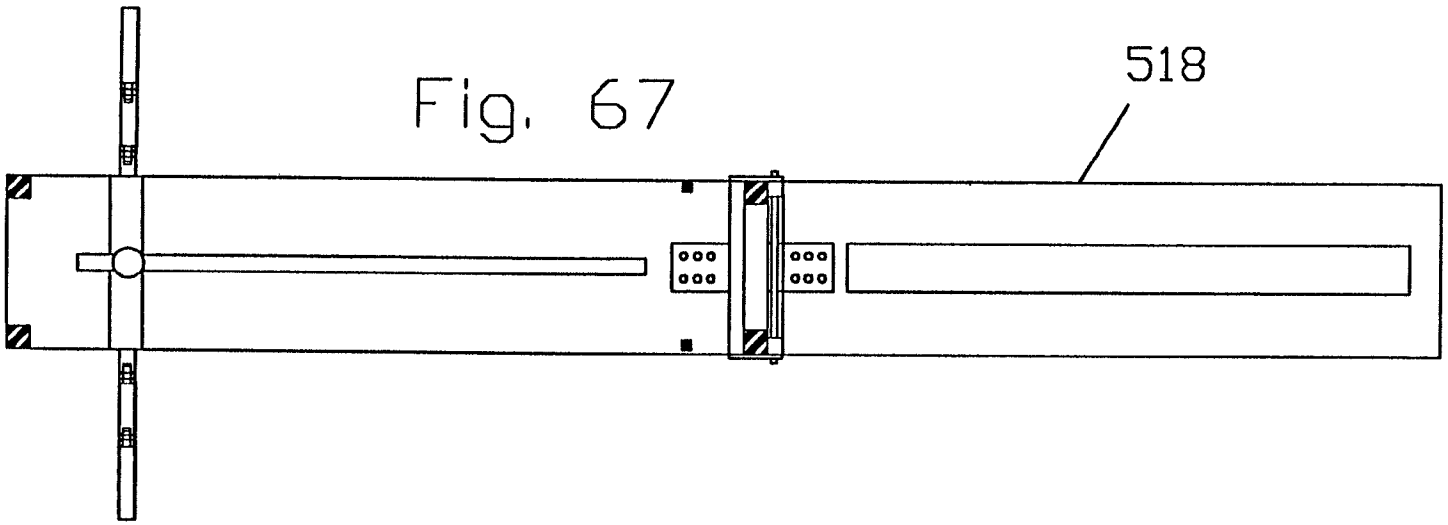
FIG. 67 is a cross-sectional view of the exercise machine of FIG. 66, taken along line 67-67 thereof.
Figure 68:
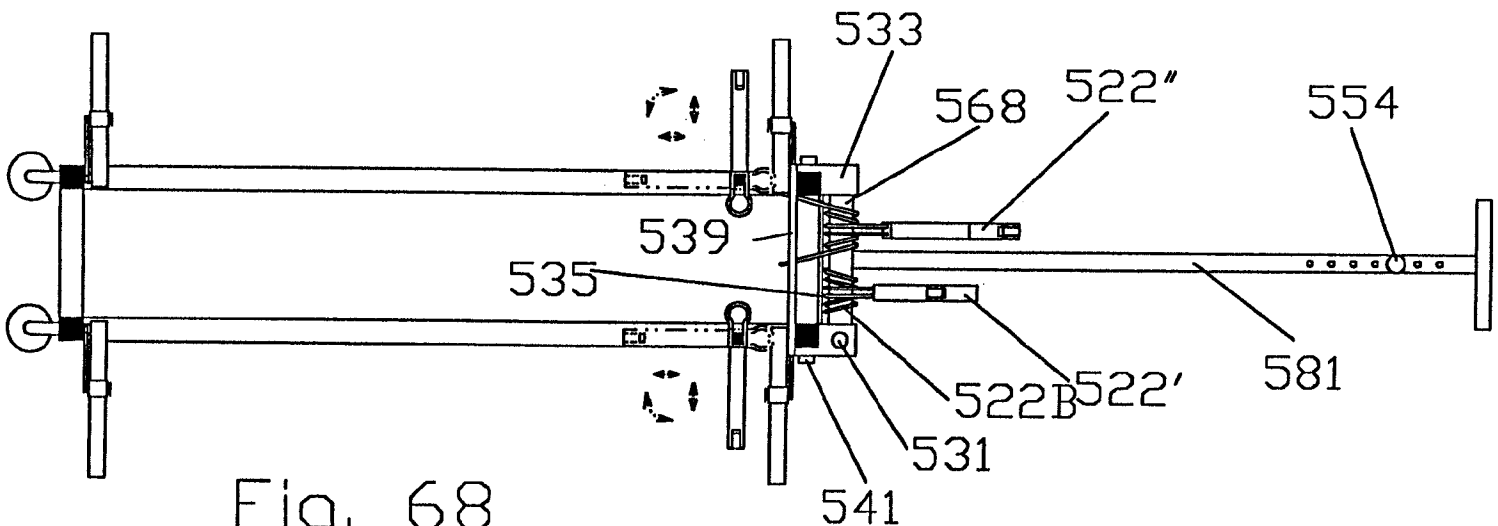
FIG. 68 is a cross-sectional view of the exercise machine of FIG. 66, taken along line 68-68 thereof.
Figure 69:
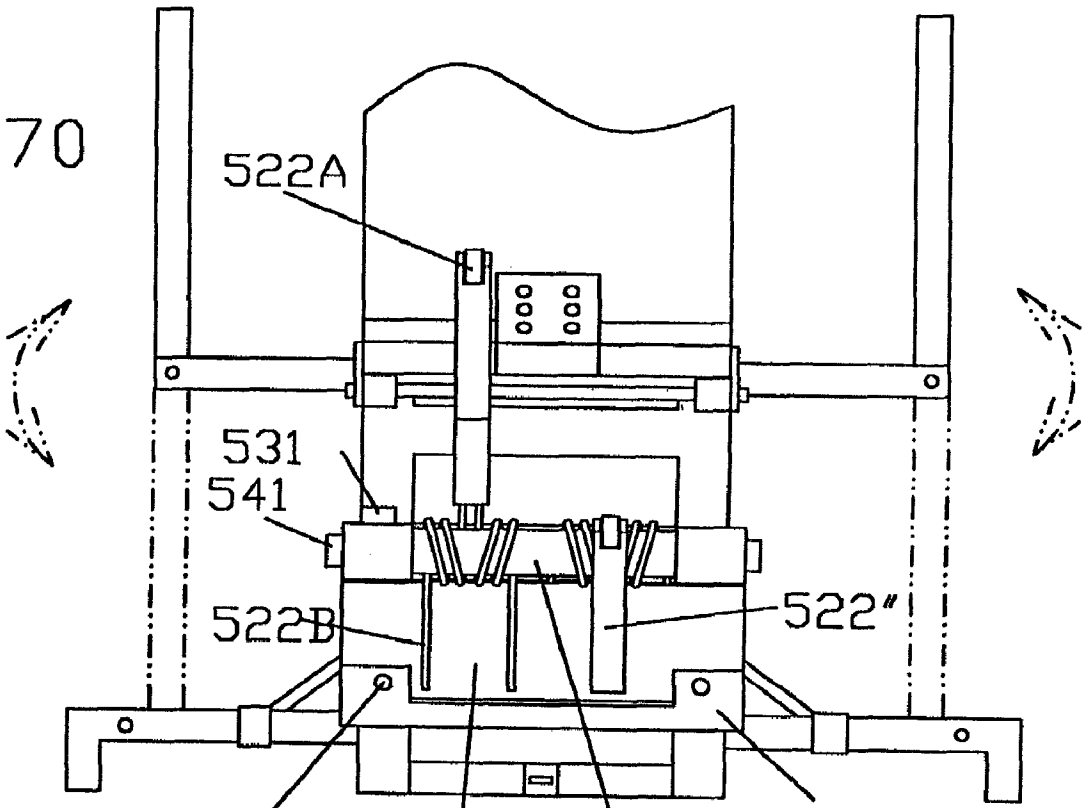
FIG. 69 is an enlarged cross-sectional view of the exercise machine of FIG. 66, taken along line 69-69 thereof.
Figure 70:
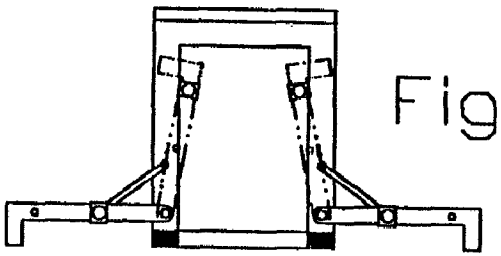
FIG. 70 is a cross-sectional view of the exercise machine of FIG. 66, taken along line 70-70 thereof.
Figure 71:
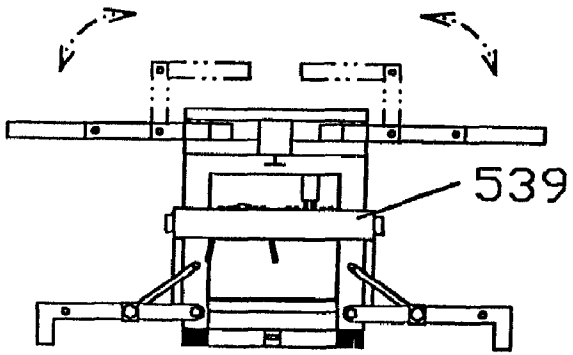
FIG. 71 is a cross-sectional view of the exercise machine of FIG. 66, taken along line 71-71 thereof.
Figure 74:
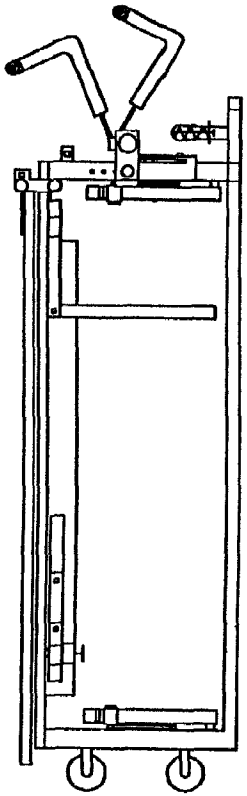
FIG. 74 is an elevational view showing the exercise machine standing up on wheels for a spacing saving purpose.
Figure 73:
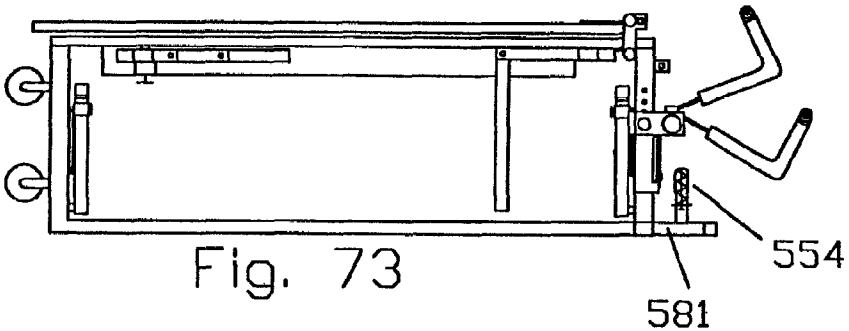
FIG. 73 is an elevational view showing the exercise machine in a closed condition.

A stop spring 554 is installed on a sliding track 581, as shown in FIGS. 66, 68 and 73. Stop spring 554 helps board 518 stop slowly, and also forms part of a board swing down angle adjuster. This allows stop spring 554 to select different holes on sliding track 581, to provide different angles for board 518 to swing down.

Sixth Embodiment

Referring to the drawings, and initially to FIGS. 75-85, an exercise machine 600 according to a sixth embodiment of the present invention includes a bench and board section 612, which is the same as that of the fourth embodiment, and accordingly, a detailed description thereof will be omitted for the sake of brevity.

Figure 76:
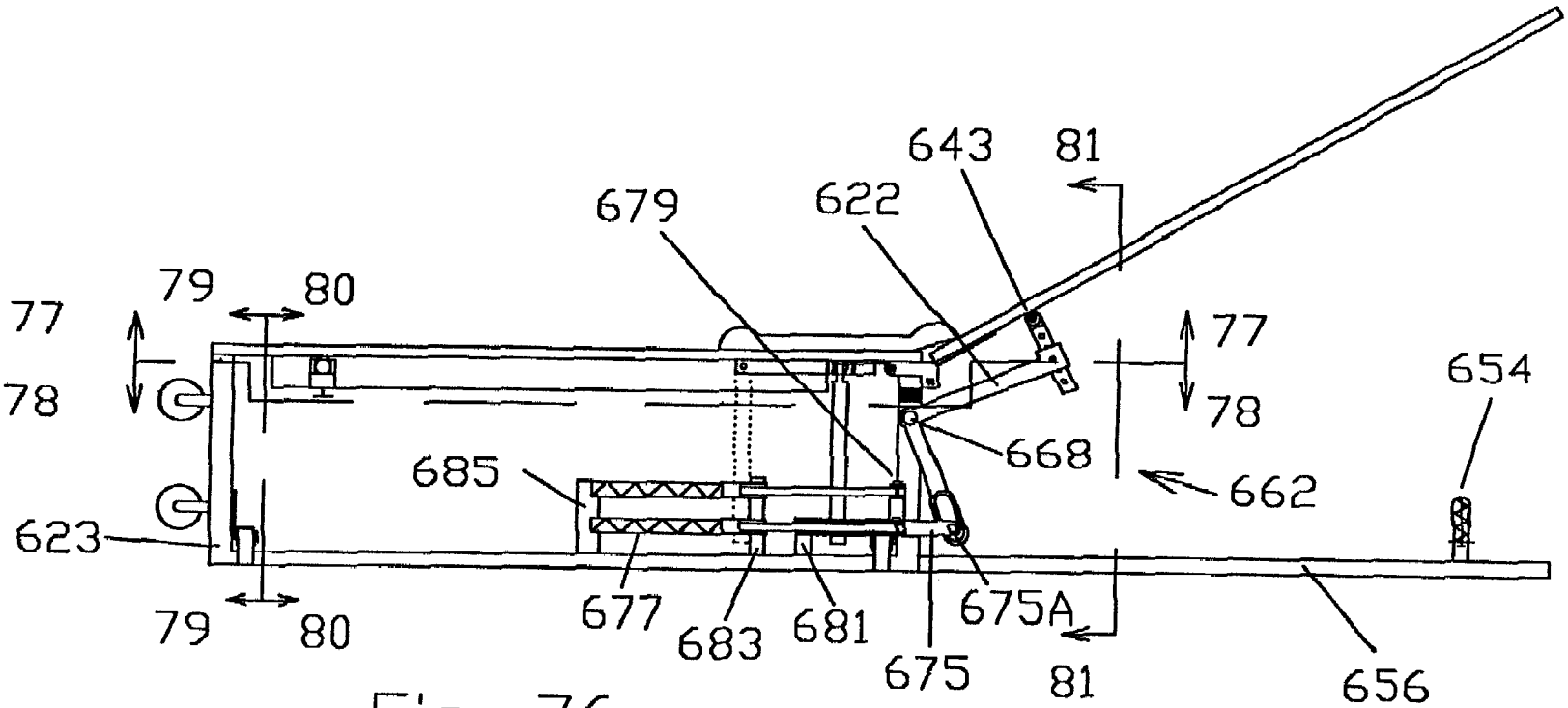
FIG. 76 is an elevational view of the exercise machine of FIG. 75.
Figure 77:
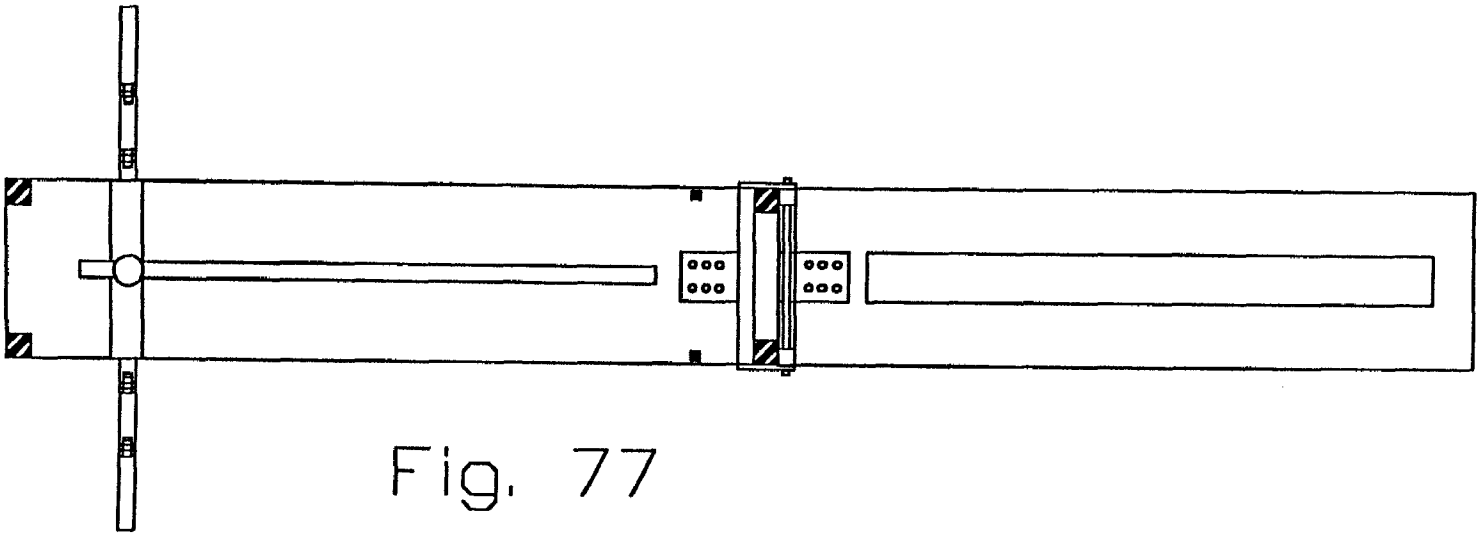
FIG. 77 is a cross-sectional view of the exercise machine of FIG. 76, taken along line 77-77 thereof.
Figure 81:
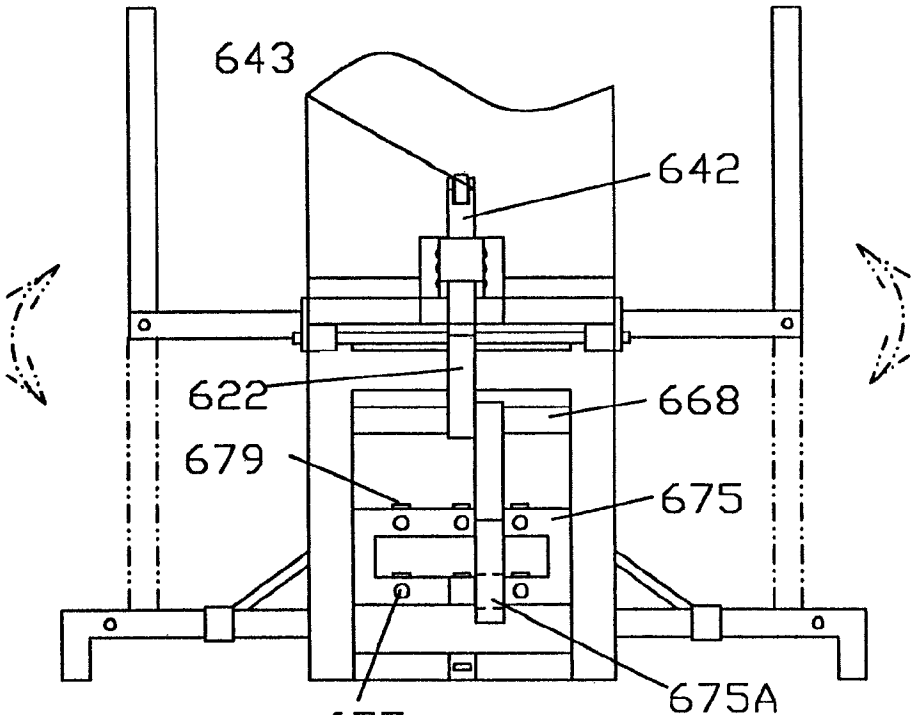
FIG. 81 is an enlarged cross-sectional view of the exercise machine of FIG. 76, taken along line 81-81 thereof.
Figure 79:
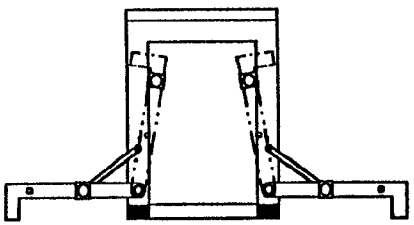
FIG. 79 is a cross-sectional view of the exercise machine of FIG. 76, taken along line 79-79 thereof.
Figure 80:
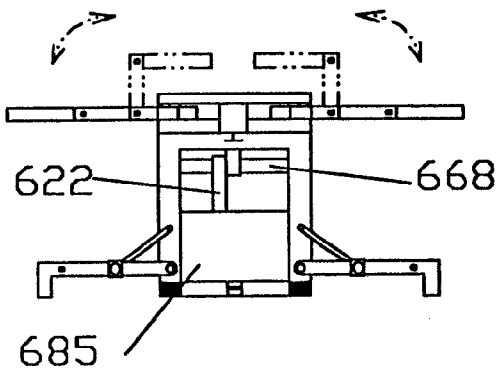
FIG. 80 is a cross-sectional view of the exercise machine of FIG. 76, taken along line 80-80 thereof.
Figure 85:
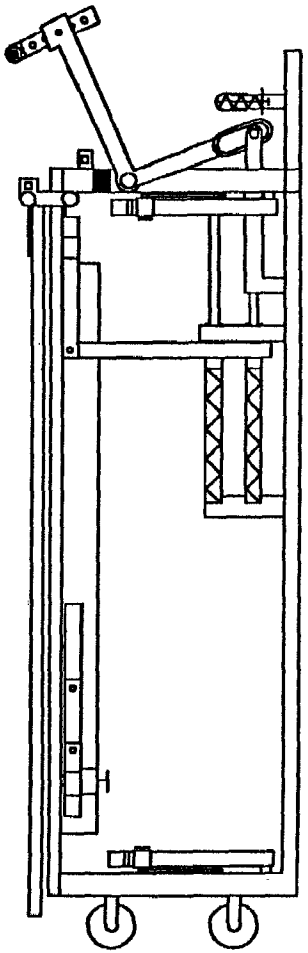
FIG. 85 is an elevational view showing the exercise machine standing up on wheels for a spacing saving purpose.
Figure 84:
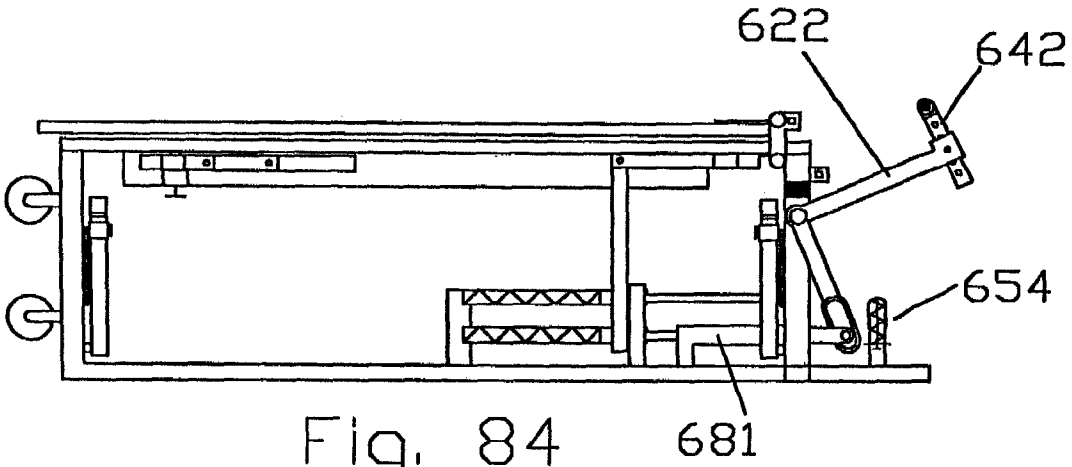
FIG. 84 is an elevational view showing the exercise machine in a closed condition.
Figure 86:
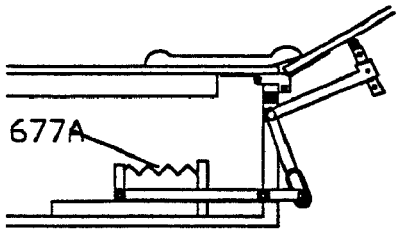
FIG. 86 is an elevational view of another resistance device that can be used in the exercise machine of the sixth embodiment.
Figure 91:
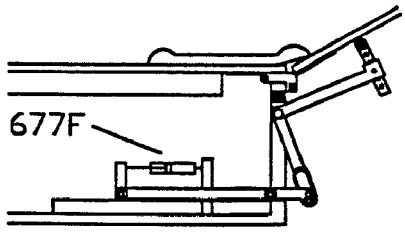
FIG. 91 is an elevational view of another resistance device that can be used in the exercise machine of the sixth embodiment.
Figure 87:
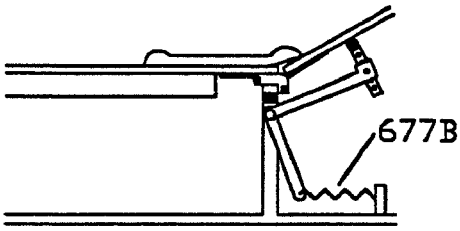
FIG. 87 is an elevational view of another resistance device that can be used in the exercise machine of the sixth embodiment.
Figure 92:
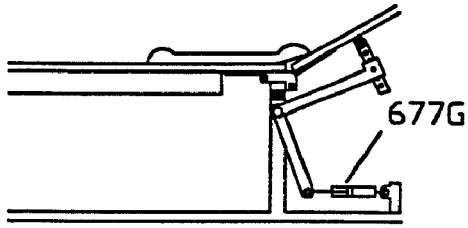
FIG. 92 is an elevational view of another resistance device that can be used in the exercise machine of the sixth embodiment.
Figure 88:
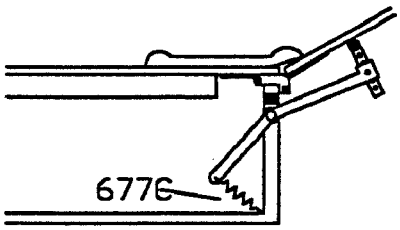
FIG. 88 is an elevational view of another resistance device that can be used in the exercise machine of the sixth embodiment.
Figure 93:
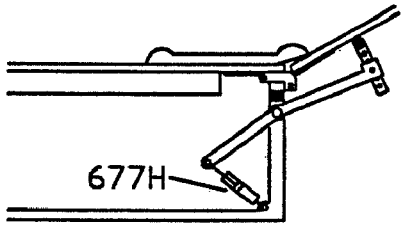
FIG. 93 is an elevational view of another resistance device that can be used in the exercise machine of the sixth embodiment.
Figure 89:
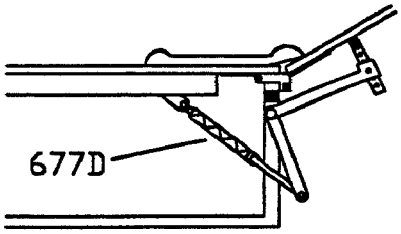
FIG. 89 is an elevational view of another resistance device that can be used in the exercise machine of the sixth embodiment.
Figure 94:
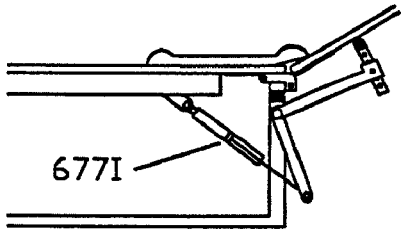
FIG. 94 is an elevational view of another resistance device that can be used in the exercise machine of the sixth embodiment.
Figure 90:
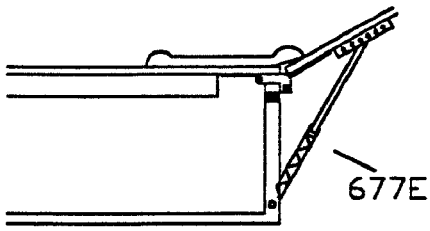
FIG. 90 is an elevational view of another resistance device that can be used in the exercise machine of the sixth embodiment.
Figure 95:
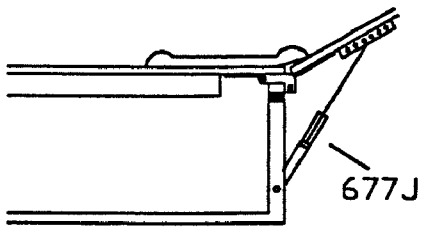
FIG. 95 is an elevational view of another resistance device that can be used in the exercise machine of the sixth embodiment.

A raising device 662 is positioned under bench and board section 612, and uses a set of compression springs to raise board 618, as shown in FIGS. 76, 81 and 84. Raising device 662 includes two arm levers 622, each mounted on an axle 668. A spring pusher 675 is biased by a set of compression springs 677, for biasing levers 622. Although there are six compression springs 677 displayed in the figures, the present invention is not limited to six compression springs, and any suitable number can be used.

Figure 78:
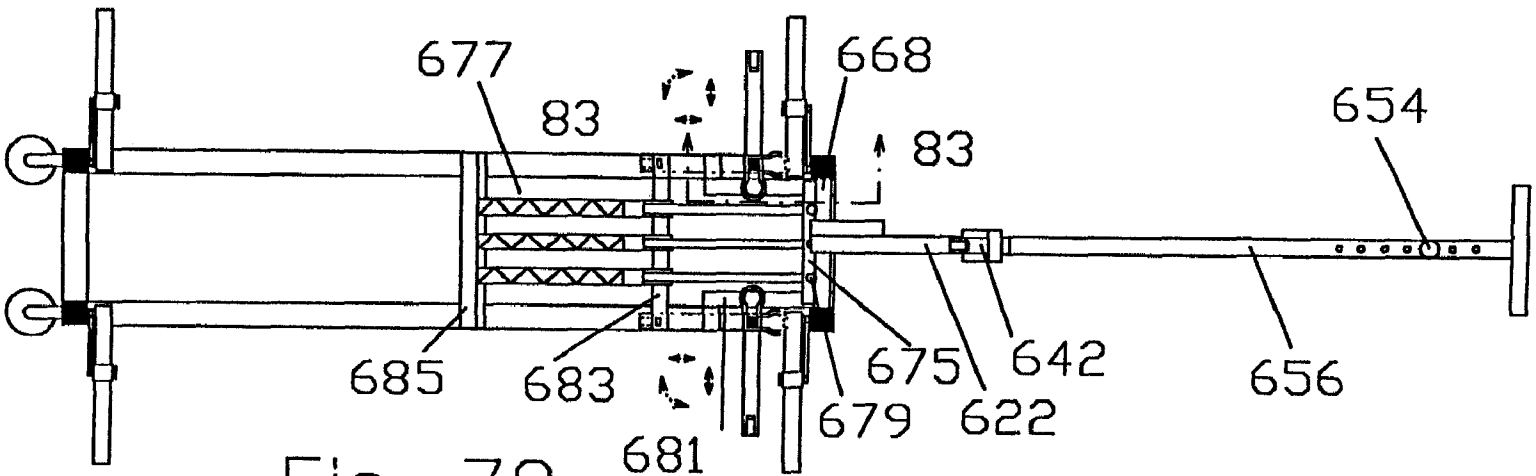
FIG. 78 is a cross-sectional view of the exercise machine of FIG. 76, taken along line 78-78 thereof.

The two arm levers 622 transmit energy from board 618 to compression spring pusher 675, and then to compression springs 677, as shown in FIGS. 76, 78 and 81. One arm lever 622 holds a board swing up angle adjuster 642 thereon which contacts the underside of raising board 618. A small wheel 643 is provided on the end of this arm lever 622 and contacts the underside of board 618 while machine 600 is in use. When board 618 swings up and down, wheel 643 moves along the bottom of the board. The other arm lever 622 is connected to spring pusher 675 by a pivot wheel 675A, with axle 668 slipped through the center of arm levers 622, as shown in FIGS. 76 and 81. Rollers 675B of spring pusher 675 provide for sliding movement of spring pusher 675.

Figure 83:
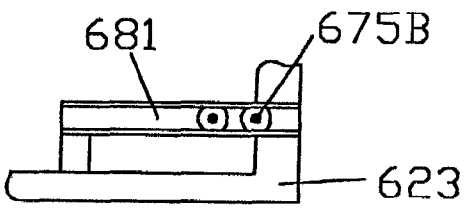
FIG. 83 is an enlarged cross-sectional view of the exercise machine of FIG. 78, taken along line 83-83 thereof.
Figure 82:
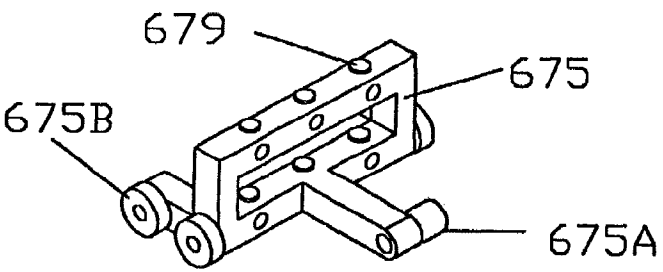
FIG. 82 is an enlarged perspective view of the spring pusher.

Spring pusher 675 pushes the aforementioned set of compression springs 677. Pins 679 releasably lock spring pusher 675 and compression springs 677 together. Thus, when pins 679 are plugged in, compression springs 677 are in use, and when pins 679 are not plugged in, compression springs 677 are not in use. Spring pusher 675 moves on sliding tracks 681 mounted to lower frame 623, as shown in FIGS. 76, 81 and 83. Spring stands 683 and 685 hold compression springs 677, as shown in FIGS. 76, 78 and 84.

A stop spring 654 is installed on a sliding track 656, as shown in FIGS. 76 and 78. Stop spring 654 helps board 618 stop slowly and thereby also functions as a board swing down angle adjuster. In this regard, stop spring 654 can be selectively secured to different holes on sliding track 656, to provide different angles for the board to swing down.

It will be appreciated that the resistance mechanism is not limited to a compression spring, nor in the manner of securement shown in the sixth embodiment, but may be constructed in a variety of styles including tension springs 677A, 677B, 677C, or compression springs 677D and 677E, as shown in FIGS. 86-90, and even air compression means 677F, 677G, 677H, 677I and 677J, as shown in FIGS. 91-95, and connected in different ways.

Having described specific preferred embodiments of the invention with reference to the accompanying drawings, it will be appreciated that the present invention is not limited to those precise embodiments and that various changes and modifications can be effected therein by one of ordinary skill in the art without departing from the scope or spirit of the invention defined by the appended claims.

What is claimed is:

1. An exercise machine comprising:

a bench and board section including a stationary bench having first and second opposite ends, and a board having first and second opposite ends, with the first end of said board pivotally mounted adjacent the second end of the stationary bench, each of the bench and board being formed substantially from a single piece which can selectively support a torso of a person and legs of the person, said stationary bench and said board are mounted on a frame, and a resistance device in contact with the single piece board and which applies a resistance to pivotal movement of the board, while permitting the board to swing up and down against a resistance applied by the resistance device, and said resistance device includes:

an axle rotatably mounted to said frame, a lever mounted on said axle and having a free end in contact with an underside of said board, and a spiral spring having a first end fixed relative to the frame and a second opposite end connected with said axle.

2. An exercise machine according to claim 1, further comprising an arrangement for adjusting a position of said first end of the spiral spring relative to the frame.

3. An exercise machine according to claim 2, wherein said arrangement for adjusting includes:

gear teeth on the frame, a gear rotatably connected with the first end of the spiral spring, a handle for moving the gear along the gear teeth to adjust the position of the first end of the spiral spring, and a securing arrangement for releasably securing the first end of the spiral spring relative to the frame after the gear has been moved along the gear teeth to a desired position.

4. An exercise machine comprising:

a bench and board section including a stationary bench having first and second opposite ends, and a board having first and second opposite ends, with the first end of said board pivotally mounted adjacent the second end of the stationary bench, each of the bench and board being formed substantially from a single piece which can selectively support a torso of a person and legs of the person, said stationary bench and said board are mounted on a frame, and a resistance device in contact with the single piece board and which applies a resistance to pivotal movement of the board, while permitting the board to swing up and down against a resistance applied by the resistance device, and said resistance device includes:

an axle mounted to said frame, at least one torsion spring mounted on said axle and having a first end fixed relative to said frame, and a second opposite end, and a lever mounted on said second opposite end of said at least one torsion spring and having a free end in contact with an underside of said board.

5. An exercise machine comprising:

a bench and board section including a stationary bench having first and second opposite ends, and a board having first and second opposite ends, with the first end of said board pivotally mounted adjacent the second end of the stationary bench, each of the bench and board being formed substantially from a single piece which can selectively support a torso of a person and legs of the person, said stationary bench and said board are mounted on a frame, and a resistance device in contact with the single piece board and which applies a resistance to pivotal movement of the board, while permitting the board to swing up and down against a resistance applied by the resistance device, and said resistance device includes:

an axle rotatably mounted to said frame, a first lever fixedly mounted on said axle and having a free end in contact with an underside of said board, a second lever fixedly mounted on said axle and having a free end, the first and second levers being oriented at different angular positions on said axle, and a spring resistance mechanism connected between said frame and the free end of said second lever.

6. An exercise machine according to claim 5, wherein said spring resistance mechanism includes at least one biasing member connected with the frame and a spring pusher connected between said at least one biasing member and the free end of said second lever.

* * * * *